US007703520B2

(12) United States Patent
Dusterhoft

(10) Patent No.: US 7,703,520 B2
(45) **Date of Patent: *Apr. 27, 2010**

(54) SAND CONTROL SCREEN ASSEMBLY AND ASSOCIATED METHODS

(75) Inventor: Ronald G. Dusterhoft, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

This patent is subject to a terminal disclaimer.

(21) Appl. No.: 12/082,644

(22) Filed: Apr. 11, 2008

(65) Prior Publication Data

US 2009/0173497 A1 Jul. 9, 2009

Related U.S. Application Data

(63) Continuation-in-part of application No. 11/970,682, filed on Jan. 8, 2008.

(51) Int. Cl.
*E21B 43/04* (2006.01)

(52) U.S. Cl. ..... 166/278; 166/51

(58) Field of Classification Search ..... 166/278, 166/380, 51, 228, 236
See application file for complete search history.

(56) References Cited

U.S. PATENT DOCUMENTS

| | | | |
|---|---|---|---|
| 921,337 | A | 5/1909 | Archer |
| 1,811,235 | A | 6/1931 | King |
| 2,945,541 | A | 7/1960 | Maly et al. |
| 2,981,333 | A | 4/1961 | Miller et al. |
| 3,390,724 | A | 7/1968 | Caldwell |
| 4,585,064 | A | 4/1986 | Graham et al. |
| 4,670,501 | A | 6/1987 | Dymond et al. |
| 5,249,627 | A | 10/1993 | Harms et al. |
| 5,833,000 | A | 11/1998 | Weaver et al. |
| 5,836,392 | A | 11/1998 | Urlwin-Smith |
| 5,839,510 | A | 11/1998 | Weaver et al. |
| 5,853,048 | A | 12/1998 | Weaver et al. |

(Continued)

FOREIGN PATENT DOCUMENTS

EP 1759086 A1 3/2007

(Continued)

OTHER PUBLICATIONS

Allison, Dave; Swellable rubber technology joins cementing; E&P Issue (May 2007); (pp. 1-2).

(Continued)

*Primary Examiner*—William P Neuder
(74) *Attorney, Agent, or Firm*—Lawrence R. Youst

(57) ABSTRACT

Methods are provided including a method comprising: placing a sand control screen in the wellbore penetrating the subterranean formation, wherein the sand control screen comprises: a base pipe having at least one opening in a sidewall portion thereof; a swellable material layer disposed exteriorly of the base pipe and having at least one opening corresponding to the at least one opening of the base pipe; a telescoping perforation operably associated with the at least one opening of the base pipe and at least partially disposed within the at least one opening of the swellable material layer; and a filter medium disposed within the telescoping perforation; and introducing a consolidating agent into at least a portion of a subterranean formation. Additional methods are also provided.

20 Claims, 10 Drawing Sheets

U.S. PATENT DOCUMENTS

| | | | | |
|---|---|---|---|---|
| 5,874,490 | A | 2/1999 | Arora et al. | |
| 5,934,376 | A | 8/1999 | Nguyen et al. | |
| 6,003,600 | A | 12/1999 | Nguyen et al. | |
| 6,192,986 | B1 | 2/2001 | Urlwin-Smith | |
| 6,196,317 | B1 | 3/2001 | Hardy | |
| 6,263,966 | B1 | 7/2001 | Haut et al. | |
| 6,302,207 | B1 | 10/2001 | Nguyen et al. | |
| 6,311,773 | B1 | 11/2001 | Todd et al. | |
| 6,427,775 | B1 | 8/2002 | Dusterhoft et al. | |
| 6,439,309 | B1 | 8/2002 | Matherly et al. | |
| 6,446,722 | B2 | 9/2002 | Nguyen et al. | |
| 6,457,518 | B1 | 10/2002 | Castano-Mears et al. | |
| 6,481,494 | B1 | 11/2002 | Dusterhoft et al. | |
| 6,540,022 | B2 | 4/2003 | Dusterhoft et al. | |
| 6,543,545 | B1 | 4/2003 | Chatterji et al. | |
| 6,557,635 | B2 | 5/2003 | Nguen et al. | |
| 6,571,872 | B2 | 6/2003 | Dusterhoft et al. | |
| 6,575,245 | B2 | 6/2003 | Hurst et al. | |
| 6,582,819 | B2 | 6/2003 | McDaniel et al. | |
| 6,588,507 | B2 | 7/2003 | Dusterhoft et al. | |
| 6,653,436 | B2 | 11/2003 | Back et al. | |
| 6,677,426 | B2 | 1/2004 | Noro et al. | |
| 6,698,519 | B2 | 3/2004 | Dusterhoft et al. | |
| 6,702,019 | B2 | 3/2004 | Dusterhoft et al. | |
| 6,719,051 | B2 | 4/2004 | Hailey, Jr. et al. | |
| 6,755,245 | B2 | 6/2004 | Nguyen et al. | |
| 6,766,862 | B2 | 7/2004 | Chatterji et al. | |
| 6,772,837 | B2 | 8/2004 | Dusterhoft et al. | |
| 6,854,522 | B2 | 2/2005 | Brezinski et al. | |
| 6,857,476 | B2 | 2/2005 | Richards | |
| 6,886,634 | B2 | 5/2005 | Richards | |
| 6,899,176 | B2 | 5/2005 | Hailey, Jr. et al. | |
| 6,956,086 | B2 | 10/2005 | Back et al. | |
| 7,013,979 | B2 | 3/2006 | Richard | |
| 7,036,587 | B2 | 5/2006 | Munoz et al. | |
| 7,096,945 | B2 | 8/2006 | Richards et al. | |
| 7,108,062 | B2 | 9/2006 | Castano-Mears et al. | |
| 7,108,083 | B2 | 9/2006 | Simonds et al. | |
| 7,114,560 | B2 | 10/2006 | Nguyen et al. | |
| 7,131,491 | B2 | 11/2006 | Blauch et al. | |
| 7,153,575 | B2 | 12/2006 | Anderson et al. | |
| 7,191,833 | B2 | 3/2007 | Richards | |
| 7,204,316 | B2 | 4/2007 | Dusterhoft et al. | |
| 7,216,706 | B2 | 5/2007 | Echols et al. | |
| 7,431,098 | B2 | 7/2007 | Ohmer et al. | |
| 7,252,142 | B2 | 8/2007 | Brezinski et al. | |
| 7,258,166 | B2 | 8/2007 | Russell | |
| 7,264,047 | B2 | 9/2007 | Brezinski et al. | |
| 7,267,171 | B2 | 9/2007 | Dusterhoft et al. | |
| 7,299,875 | B2 | 11/2007 | Nguyen et al. | |
| 7,299,882 | B2 | 11/2007 | Brezinski et al. | |
| 7,320,367 | B2 | 1/2008 | Brezinski et al. | |
| 7,520,327 | B2 | 1/2008 | Surjaatmadja | |
| 7,350,579 | B2 | 4/2008 | Gatlin et al. | |
| 7,363,986 | B2 | 4/2008 | Brezinski et al. | |
| 7,373,991 | B2 | 5/2008 | Vaidya et al. | |
| 7,387,165 | B2 | 6/2008 | Lopez de Cardenas et al. | |
| 7,392,847 | B2 | 7/2008 | Gatlin | |
| 7,404,437 | B2 | 7/2008 | Brezinski et al. | |
| 7,426,962 | B2 | 9/2008 | Moen et al. | |
| 7,451,815 | B2 | 11/2008 | Hailey | |
| 7,493,947 | B2 * | 2/2009 | Ross | 166/228 |
| 7,511,487 | B2 | 3/2009 | Badry et al. | |
| 2004/0060695 | A1 | 4/2004 | Castano-Mears et al. | |
| 2005/0077052 | A1 | 4/2005 | Ohmer | |
| 2005/0126776 | A1 | 6/2005 | Russell | |
| 2005/0277554 | A1 | 12/2005 | Blauch et al. | |
| 2005/0284633 | A1 | 12/2005 | Richard | |
| 2006/0042801 | A1 | 3/2006 | Hackworth et al. | |
| 2006/0090903 | A1 | 5/2006 | Gano et al. | |
| 2006/0108114 | A1 | 5/2006 | Johnson | |
| 2006/0175065 | A1 | 8/2006 | Ross | |
| 2006/0185849 | A1 * | 8/2006 | Edwards et al. | 166/296 |
| 2006/0186601 | A1 | 8/2006 | Lopez | |
| 2007/0012436 | A1 | 1/2007 | Freyer | |
| 2007/0114018 | A1 | 5/2007 | Brezinski et al. | |
| 2007/0131422 | A1 | 6/2007 | Gatlin et al. | |
| 2007/0131425 | A1 | 6/2007 | Gatlin et al. | |
| 2007/0131434 | A1 | 6/2007 | MacDougall et al. | |
| 2007/0257405 | A1 | 11/2007 | Freyer | |
| 2007/0272411 | A1 | 11/2007 | Lopez de Cardenas et al. | |
| 2008/0006405 | A1 | 1/2008 | Rickman et al. | |
| 2008/0035349 | A1 | 2/2008 | Richard | |
| 2008/0078561 | A1 | 4/2008 | Chalker et al. | |
| 2008/0093086 | A1 | 4/2008 | Courvile et al. | |
| 2008/0125335 | A1 | 5/2008 | Bhavsar | |
| 2008/0149351 | A1 | 6/2008 | Marya et al. | |
| 2008/0156492 | A1 | 7/2008 | Bosma et al. | |
| 2008/0194717 | A1 | 8/2008 | Vaidya et al. | |
| 2008/0217002 | A1 | 9/2008 | Simonds et al. | |
| 2008/0283240 | A1 | 11/2008 | Baaijens et al. | |
| 2009/0173490 | A1 | 7/2009 | Dusterhoft et al. | |
| 2009/0173497 | A1 | 7/2009 | Dusterhoft | |

FOREIGN PATENT DOCUMENTS

| | | | |
|---|---|---|---|
| EP | 1792049 | A1 | 6/2007 |
| GB | 2421527 | A | 6/2006 |
| WO | 96 26350 | A1 | 8/1996 |
| WO | 03 052238 | A1 | 6/2003 |
| WO | 2004 018836 | A1 | 3/2004 |
| WO | 2004022911 | | 3/2004 |
| WO | 2005 056977 | A1 | 6/2005 |
| WO | 2005 100743 | A1 | 10/2005 |
| WO | 2005 124091 | A1 | 12/2005 |
| WO | 2006 003112 | A1 | 1/2006 |
| WO | 2006 003113 | A1 | 1/2006 |
| WO | 2006 113500 | A1 | 10/2006 |
| WO | 2007092082 | | 8/2007 |
| WO | 2007092083 | | 8/2007 |
| WO | 2007126496 | | 11/2007 |
| WO | 2008070674 | | 6/2008 |
| WO | WO 2008/122809 | A1 | 10/2008 |
| WO | 2009001073 | | 12/2008 |

OTHER PUBLICATIONS

Hembling, Drew; Aramco uses swell packers to enable smart open-hole, multilateral completions for EOR; Completions article (Sep./Oct. 2007); (pp. 108-114).

Cleanable Media Products; http://purolator-facet.com/media.htm; (Nov. 27, 2007); (pp. 1-3).

Bybee, Karen; Swelling Packers Solve Zonal-Isolation Challenge in Oman High-Pressure Wells; HP/HT halleges article; (Mar. 2007); (pp. 75-79).

Baker Hughes; Sand Control Systems and Products; http://www.prntthis.clickability.com/pt/cpt?action=cpt &title=Baker+Oil+tools+sand=Con; (Apr. 2007) (pp. 1-3).

International Search Report and Written Opinion, European Patent Office; Aug. 5, 2009.

PCT Search Report and Written Opinion (Oct. 29, 2009).

International Search Report and Written Opinion—PCT/US2009/054957, International Searching Authority, Dec. 12, 2009.

* cited by examiner

SAND CONTROL SCREEN ASSEMBLY AND ASSOCIATED METHODS

CROSS-REFERENCE TO RELATED APPLICATIONS

The present application is a continuation-in-part of U.S. patent application Ser. No. 11/970,682, entitled "Sand Control Screen Assembly and Method For Use of Same" filed on Jan. 8, 2008, the entirety of which is herein incorporated by reference.

BACKGROUND

The present invention relates to methods useful in treating subterranean formations and, more particularly, to consolidating a potentially unconsolidated portion of a subterranean formation and minimizing the production of unconsolidated particulate materials such as formation fines and sand (referred to collectively herein as "particulate migration"). More specifically, the present invention relates to methods for introducing a consolidating agent into a subterranean formation and placing a sand control screen in at least a portion of a wellbore.

Without limiting the scope of the present invention, its background is described with reference to the production of hydrocarbons through a wellbore traversing an unconsolidated or loosely consolidated formation, as an example.

Hydrocarbon wells are often located in subterranean formations. that contain unconsolidated particulates (e.g., sand, gravel, proppant, fines, etc.) that may migrate out of the subterranean formation into a wellbore and/or may be produced with the oil, gas, water, and/or other fluids produced by the well. The presence of such particulates in produced fluids is undesirable in that the particulates may abrade pumping and other producing equipment and/or reduce the production of desired fluids from the well. Moreover, particulates that have migrated into a wellbore (e.g., inside the casing and/or perforations in a cased hole), among other things, may clog portions of the wellbore, hindering the production of desired fluids from the well. The term "unconsolidated particulates," and derivatives thereof, is defined herein to include loose particulates and particulates bonded with insufficient bond strength to withstand the forces created by the flow of fluids through the formation, which may cause the particulates to shift or migrate within the formation and/or into voids therein. Unconsolidated particulates may comprise, among other things, sand, gravel, fines and/or proppant particulates in the subterranean formation, for example, proppant particulates placed in the subterranean formation in the course of a fracturing or gravel-packing operation. The terms "unconsolidated subterranean formation," "unconsolidated portion of a subterranean formation," and derivatives thereof are defined herein to include any formation that contains unconsolidated particulates, as that term is defined herein. "Unconsolidated subterranean formations" and "unconsolidated portions of a subterranean formation," as those terms are used herein, include subterranean fractures wherein unconsolidated particulates reside within the open space of the fracture (e.g., forming a proppant pack within the fracture).

One method of controlling unconsolidated particulates in subterranean formations involves placing a filtration bed containing gravel (e.g., a "gravel pack") near the wellbore to present a physical barrier to the transport of unconsolidated particulates with the production of desired fluids. Typically, such "gravel-packing operations" involve the pumping and placement of a quantity of particulate into the unconsolidated subterranean formation in an area adjacent to a wellbore. One common type of gravel-packing operation involves placing a screen in the wellbore and packing the surrounding annulus between the screen and the wellbore with gravel of a specific size designed to prevent the passage of formation sand. The screen is generally a filter assembly used to retain the gravel placed during the gravel-pack operation. A wide range of sizes and screen configurations are available to suit the characteristics of the gravel used. Similarly, a wide range of sizes of gravel is available to suit the characteristics of the unconsolidated particulates in the subterranean formation. To install the gravel pack, the gravel is carried to the formation in the form of a slurry by mixing the gravel with a liquid carrier fluid, which is usually viscosified. Once the gravel is placed in the wellbore, the viscosity of the fluid may be reduced, and the fluid either flows into the formation or is returned to the surface. The resulting structure presents a barrier to migrating particulates from the formation while still permitting fluid flow.

It has been found, however, that a complete gravel pack of the desired production interval is difficult to achieve particularly in long or inclined/horizontal production intervals. These incomplete packs are commonly a result of the liquid carrier fluid entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

In certain open hole completions where gravel packing may not be feasible, attempts have been made to use expandable sand control screens. Typically, expandable sand control screens are designed to not only filter particulate materials out of the formation fluids, but also provide radial support to the formation to prevent the formation from collapsing into the wellbore. It has been found, however, that conventional expandable sand control screens are not capable of contacting the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore. In addition, it has been found that the expansion process undesirably weakens such sand control screens.

Additionally, in open hole completions, a stand alone screen may be used. Typically, stand alone screens may be used when the formation generally comprises a more uniform particle size distribution. However, when a formation comprises a wider range of particle sizes, a stand alone screen is not desirable because it is difficult to design a screen that will not plug. In addition, exposed shale also creates problems in these situations because the shale tends to slough when exposed to lower pressures, generating large volumes of fines that can flow into the annulus and plug the screen.

More recently, attempts have been made to install sand control screens that include telescoping screen members. Typically, hydraulic pressure is used to extend the telescoping screen members radially outwardly toward the wellbore. This process requires providing fluid pressure through the entire work string that acts on the telescoping members to shift the members from a partially extended position to a radially extended position. It has been found, however, that in substantially horizontal production intervals, the telescoping screen members may not properly deploy, particularly along the portion of the production string resting on the bottom surface of the wellbore. Failure to fully extend all the telescoping screen members results in a non uniform inner bore which may prevent the passage of tools therethrough.

SUMMARY

The present invention relates to methods useful in treating subterranean formations and, more particularly, to consolidating a potentially unconsolidated portion of a subterranean formation and minimizing the production of unconsolidated particulate materials such as formation fines and sand (referred to collectively herein as "particulate migration"). More specifically, the present invention relates to methods for introducing a consolidating agent into a subterranean formation and placing a sand control screen in at least a portion of a wellbore.

In one embodiment, the present invention provides a method comprising: placing a sand control screen in the wellbore penetrating the subterranean formation, wherein the sand control screen comprises: a base pipe having at least one opening in a sidewall portion thereof; a swellable material layer disposed exteriorly of the base pipe and having at least one opening corresponding to the at least one opening of the base pipe; a telescoping perforation operably associated with the at least one opening of the base pipe and at least partially disposed within the at least one opening of the swellable material layer; and a filter medium disposed within the telescoping perforation; and introducing a consolidating agent into at least a portion of a subterranean formation.

In another embodiment, the present invention provides a method comprising: placing a sand control screen in the wellbore penetrating the subterranean formation, wherein the sand control screen comprises: a base pipe having at least one opening in a sidewall portion thereof; a swellable material layer disposed exteriorly of the base pipe and having at least one opening corresponding to the at least one opening of the base pipe; a telescoping perforation operably associated with the at least one opening of the base pipe and at least partially disposed within the at least one opening of the swellable material layer; and a filter medium disposed within the telescoping perforation; introducing a consolidating agent into at least a portion of a subterranean formation; and contacting the swellable material layer with an activating fluid, wherein, in response to contact with an activating fluid, radial expansion of the swellable material layer causes the telescoping perforation to radially outwardly extend.

In yet another embodiment, the present invention provides a method comprising: placing a sand control screen in the wellbore penetrating the subterranean formation, wherein the sand control screen comprises: a base pipe having a plurality of openings in a sidewall portion thereof and defining an internal flow path; a swellable material layer disposed exteriorly of the base pipe and having a plurality of openings that correspond to the openings of the base pipe; a plurality of telescoping perforations, each of the telescoping perforations operably associated with one of the openings of the base pipe and at least partially disposed within the corresponding opening of the swellable material layer, the telescoping perforations providing fluid flow paths between a fluid source disposed exteriorly of the base pipe and the interior flow path; and a filter medium disposed within each of the telescoping perforations; and introducing a consolidating agent into at least a portion of a subterranean formation.

The features and advantages of the present invention will be readily apparent to those skilled in the art. While numerous changes may be made by those skilled in the art, such changes are within the spirit of the invention.

BRIEF DESCRIPTION OF THE DRAWINGS

For a more complete understanding of the features and advantages of the present invention, reference is now made to the description of the preferred embodiments along with the accompanying figures in which corresponding numerals in the different figures refer to corresponding parts. These drawings illustrate certain aspects of some of the embodiments of the present invention, and should not be used to limit or define the invention.

DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

The present invention relates to methods useful in treating subterranean formations and, more particularly, to consolidating a potentially unconsolidated portion of a subterranean formation and minimizing the production of unconsolidated particulate materials such as formation fines and sand (referred to collectively herein as "particulate migration"). More specifically, the present invention relates to methods for placing a sand control screen in at least a portion of a wellbore and introducing a consolidating agent into at least a portion of a subterranean formation.

The methods of the present invention may be applicable to horizontal, vertical, deviated, or otherwise nonlinear wellbores in any type of subterranean formation. The methods may be applicable to injection wells as well as production wells, including hydrocarbon wells. One of the many potential advantages of the methods of the present invention (many of which are not discussed or eluded to herein) is that a sand control screen comprising a base pipe, a swellable material layer disposed exteriorly of the base pipe, at least one telescoping perforation, and a filter medium disposed within the telescoping perforation, may be placed in the wellbore to minimize the production of unconsolidated particulate material and/or to stabilize at least a portion of a wellbore. In addition, a consolidating agent may be placed in at least a portion of a subterranean formation to at least partially control particulate migration, which otherwise may negatively impact the conductivity of the formation.

Figure 1A:
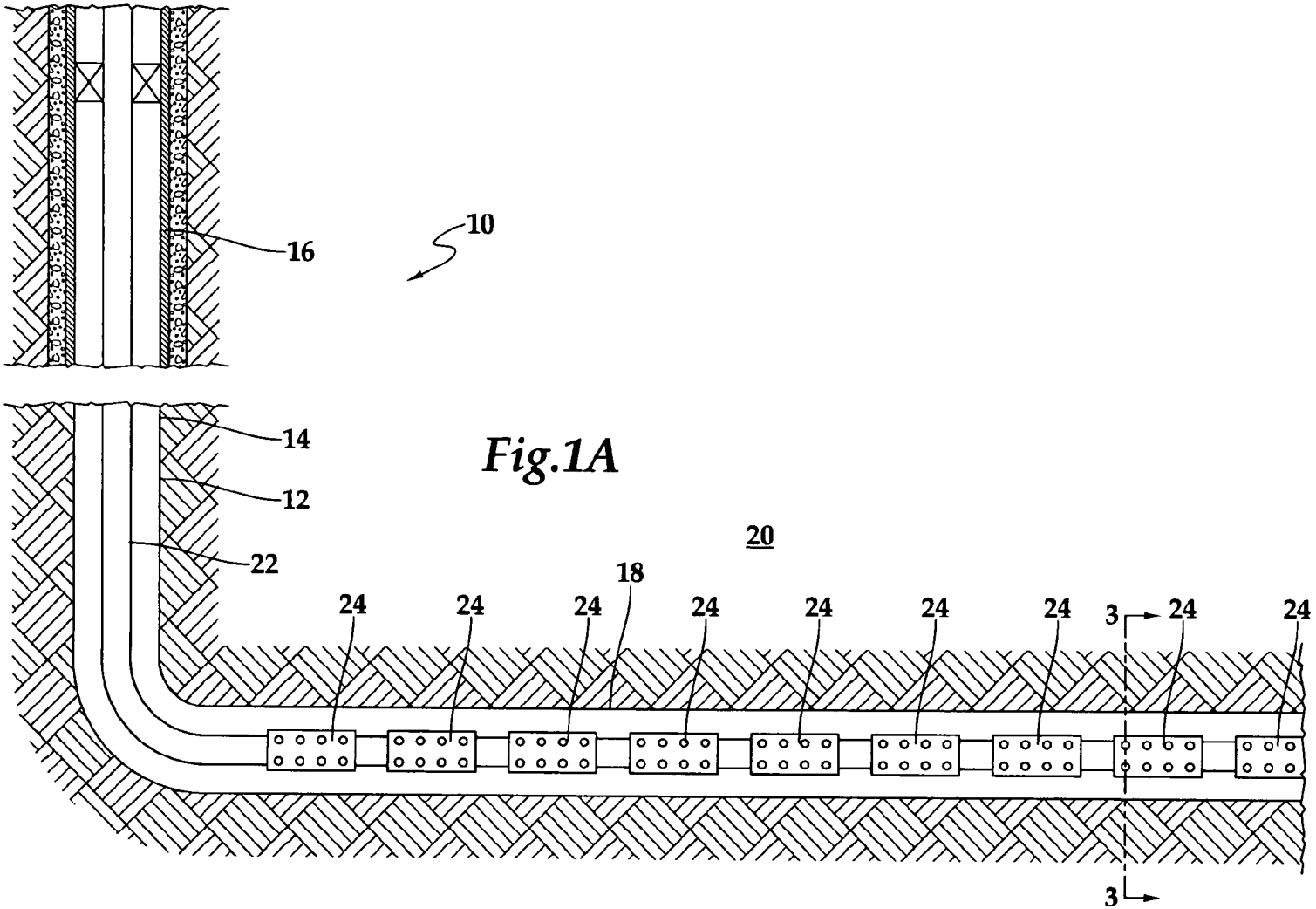
FIG. 1A is a schematic illustration of a well system operating a plurality of sand control screen assemblies in a run in configuration according to an embodiment of the present invention.

According to the methods of the present invention, a sand control screen assembly is placed into a portion of a wellbore penetrating a subterranean formation. Referring now to FIG. 1A, therein is depicted a well system including a plurality of sand control screen assemblies embodying principles of the present invention that are schematically illustrated and generally designated 10. In the illustrated embodiment, a wellbore 12 extends through the various earth strata. Wellbore 12 has a substantially vertical section 14, the upper portion of which has installed therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a plurality of sand control screen assemblies 24. The sand control screen assemblies 24 are shown in a run in or unextended configuration.

Figure 1B:
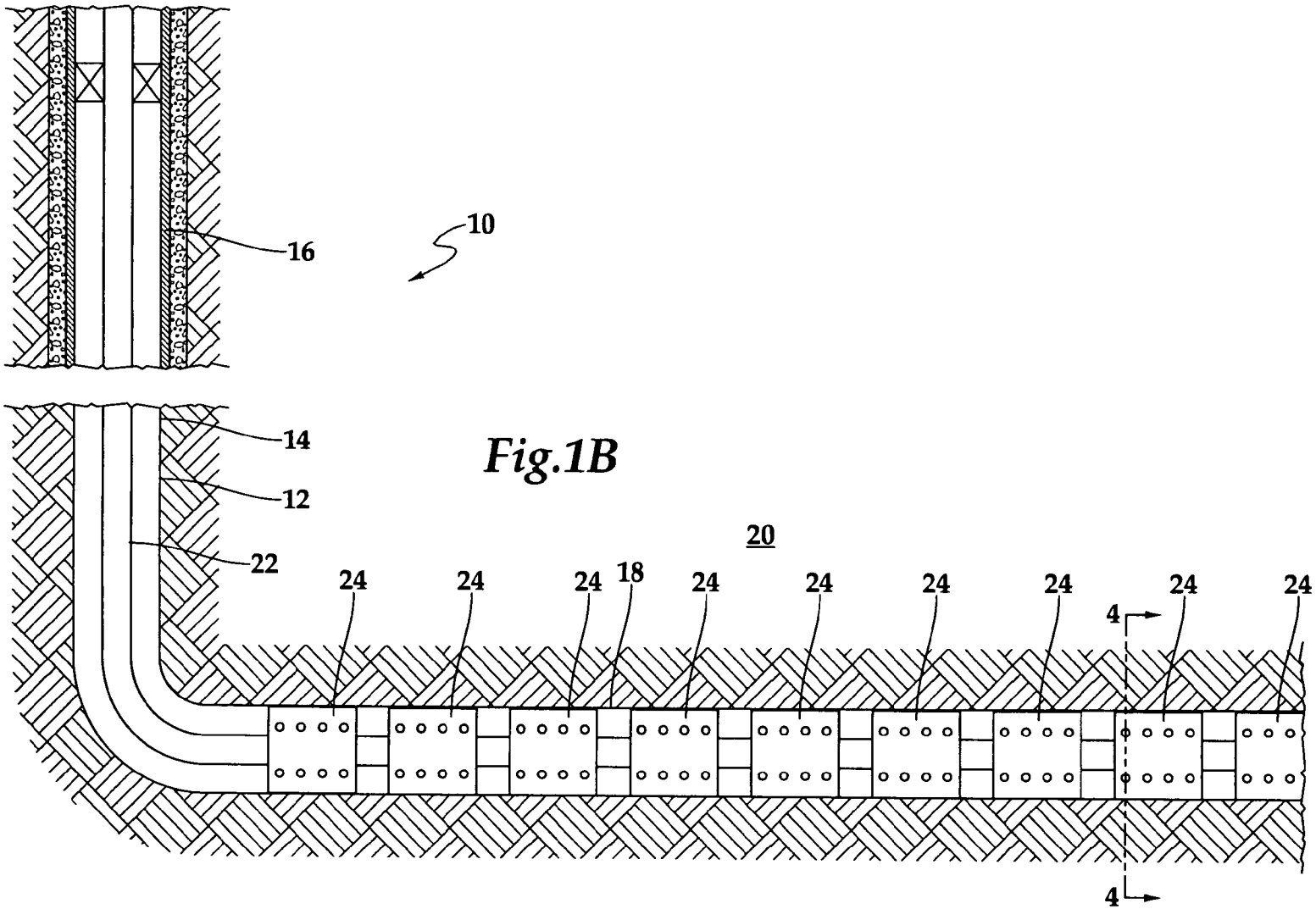
FIG. 1B is a schematic illustration of the well system operating a plurality of sand control screen assemblies in an operating configuration according to an embodiment of the present invention.

Referring next to FIG. 1B, therein is depicted the well system of FIG. 1A with sand control screen assemblies 24 in their radially expanded configuration. As explained in greater detail below, when the swellable material layer of sand control screen assemblies 24 come in contact with an activating fluid, such as a hydrocarbon fluid, the swellable material layer racially expands which in turn causes telescoping perforations of sand control screen assemblies 24 to radially outwardly extend. Preferably, as illustrated in FIG. 1B, swellable material layer and telescoping perforations come in contact with formation 20 upon expansion.

Figure 2A:
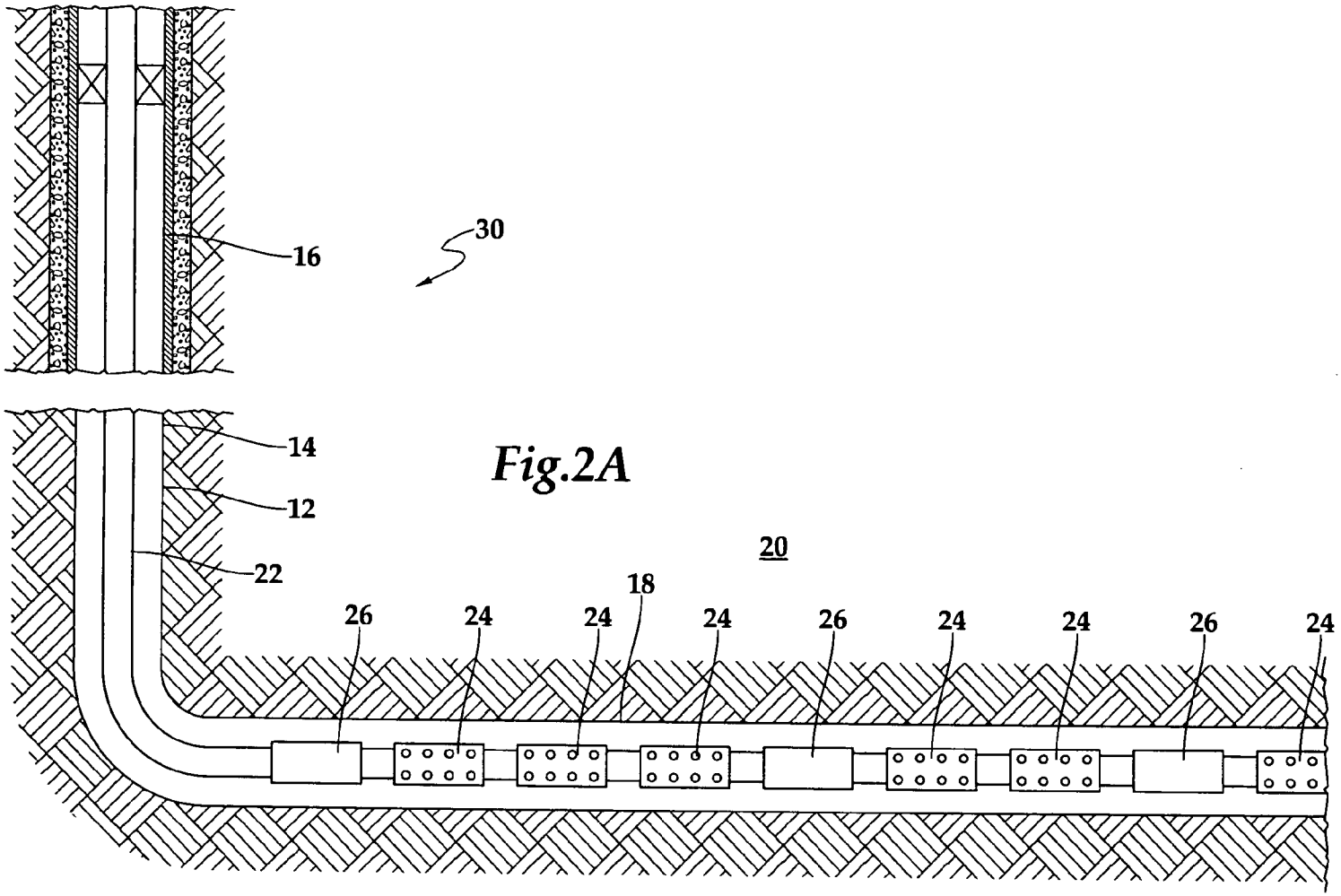
FIG. 2A is a schematic illustration of a well system operating a plurality of sand control screen assemblies in a run in configuration according to an embodiment of the present invention.
Figure 2B:
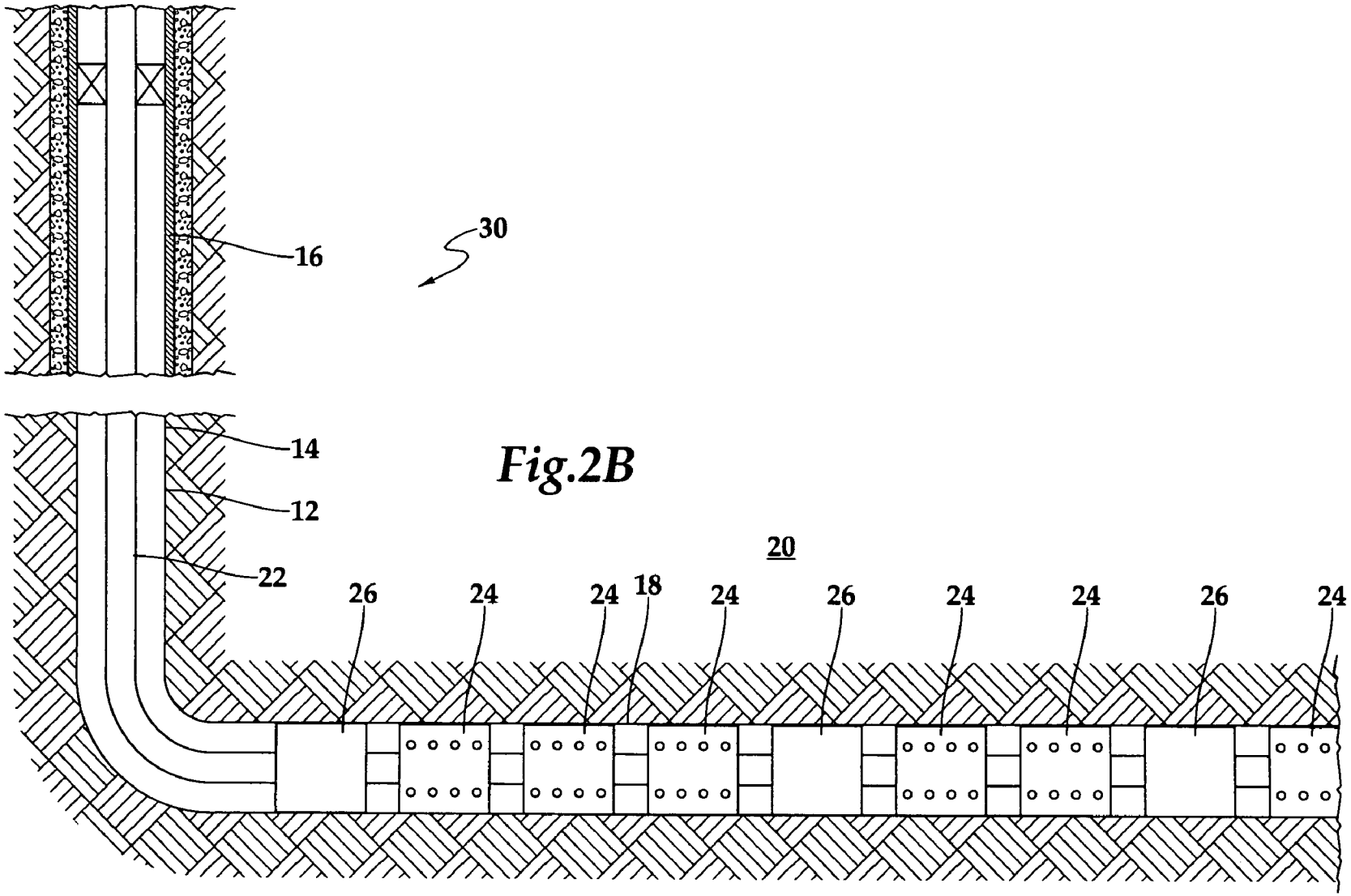
FIG. 2B is a schematic illustration of a well system operating a plurality of sand control screen assemblies in an operating configuration according to an embodiment of the present invention.

Referring to FIGS. 2A-2B, therein is depicted a well system including a plurality of sand control screen assemblies 24 embodying principles of the present invention that are schematically illustrated and generally designated 30. In addition to those elements located in FIG. 2A common to FIGS. 1A-1B, the tubing string 22 may further be divided up into a plurality of intervals using zone isolation devices and/or swellable zone isolation devices 26 or other sealing devices, such as packers, between adjacent sand control screen assemblies 24 or groups of sand control screen assemblies 24. The zone isolation devices 26 may swell between the tubing string 22 and the wellbore 12 in horizontal section 18, as depicted in FIG. 2B, to provide zone isolation for those adjacent sand control screen assemblies 24 or groups of sand control screen assemblies 24 located between one or more zone isolation devices 26.

These zone isolation devices 26 may be made from materials that swell upon contact by a fluid, such as an inorganic or organic fluid. Some exemplary fluids that may cause the zone isolation devices 26 to swell and isolate include water and hydrocarbons.

In addition, even though FIGS. 1A-2B depict the sand control screen assemblies of the present invention in a horizontal section of the wellbore, it should be understood by those skilled in the art that the sand control screen assemblies of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 3:
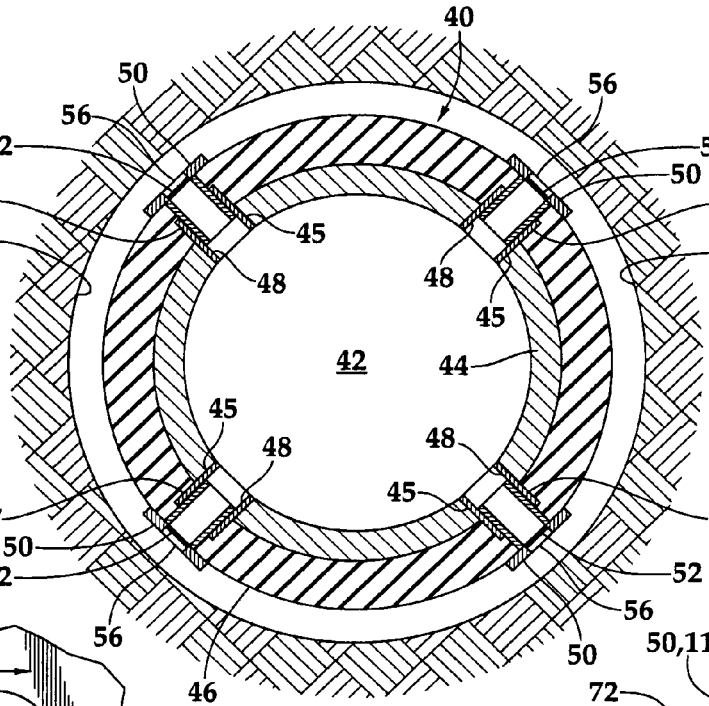
FIG. 3 is a cross sectional view taken along line 3-3 of the sand control screen assembly of FIG. 1A.

Referring to FIG. 3, therein is depicted a cross sectional view of a sand control screen assembly in its run in configuration that embodies principles of the present invention and is generally designated 40. Sand control screen assembly 40 includes base pipe 44 that defines an internal flow path 42. Base pipe 44 has a plurality of openings 45 that allow fluid to pass between the exterior of base pipe 44 and internal flow path 42. Sand control screen assembly 40 includes a concentric layer of swellable material 46 that circumferentially surrounds base pipe 44. Swellable material 46 has a plurality of openings 47 that correspond to openings 45 of base pipe 44. In the illustrated embodiment, sand control screen assembly 40 includes a plurality of telescoping perforations 48. The proximal ends of the telescoping perforations 48 are connected to the base pipe 44 by means of threading, welding, friction fit or the like. The distal ends of the telescoping perforations 48 terminate at a face plate 50 that is positioned exterior of or embedded in the exterior surface of swellable material 46. Telescoping perforations 48 provide a fluid conduit or passageway between the distal ends and the proximal ends of the telescoping perforations 48 that passes through swellable material 46 and base pipe 44. Disposed within each telescoping perforation 48 is a filter media 52.

The filter media 52 may comprise a mechanical screening element such as a fluid-porous, particulate restricting, metal screen having a plurality of layers of woven wire mesh that may be diffusion bonded or sintered together to form a porous wire mesh screen designed to allow fluid flow therethrough but prevent the flow of particulate materials of a predetermined size from passing therethrough. Alternatively, filter media 52 may be formed from other types of sand control medium, such as gravel pack material, metallic beads such as stainless steel beads or sintered stainless steel beads, wire screens, which may be round, square, rectangular, triangular or any other shape deemed to be suitable for a filtration surface, and the like.

Figure 4:
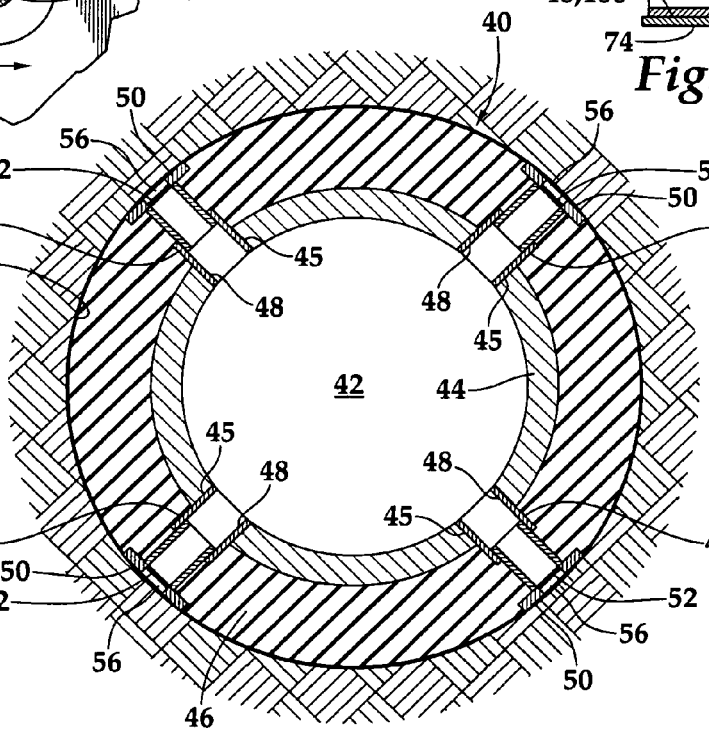
FIG. 4 is a cross sectional view taken along line 4-4 of the sand control screen assembly of FIG. 1B.

Referring additionally now to FIG. 4, therein is depicted a cross sectional view of sand control screen assembly 40 in its operating configuration. In the illustrated embodiment, swellable material 46 has come in contact with an activating fluid, such as a hydrocarbon fluid, that has caused swellable material 46 to radially expand into contact with the surface of the wellbore 54, which in the illustrated embodiment is the formation face. In addition, the radial expansion of swellable material 46 has caused telescoping perforations 48 to radially outwardly extend into contact with the surface of the wellbore 54. In this embodiment, a stand off region 56 is provided between filter media 52 and wellbore 54 such that filter media 52 does not come into physical contact with the surface of the formation.

Figure 5:
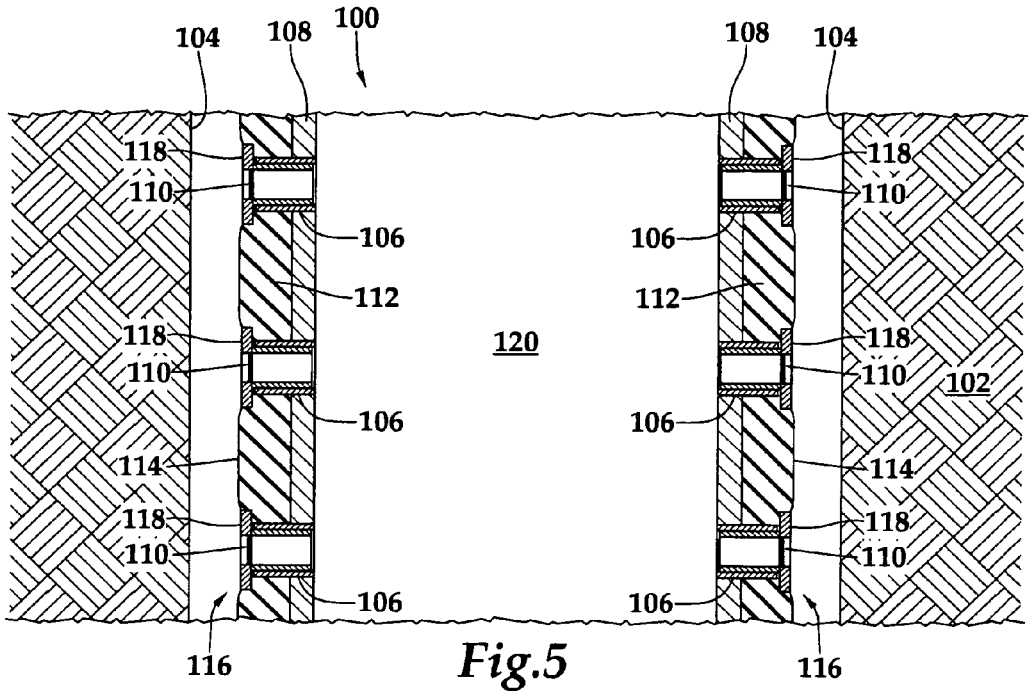
FIG. 5 is a side view of a sand control screen assembly in a run in configuration according to an embodiment of the present invention.

Referring next to FIG. 5, therein is depicted a side view of a sand control screen assembly in its run in configuration that embodies principles of the present invention and is generally designated 100. In this embodiment, the sand control screen assembly 100 is located within an open hole portion of formation 102 having a surface 104. The sand control screen assembly 100 includes one or more telescoping perforations 106 that are shown in an unextended position.

The sand control screen assembly 100 includes a concentric layer of swellable material 112 that surrounds a base pipe 108 having an interior flow path 120. In one aspect, the telescoping perforations 106 include a face plate 118 and a filter medium 110. The swellable material 112 includes an outer surface 114. In the illustrated embodiment, face plates 118 are embedded within swellable material 112 such that a substantially smooth outer surface is established in the run in configuration. Located between the outer surface 114 and the surface 104 of the formation 102 is an annular region 116.

Figure 6:
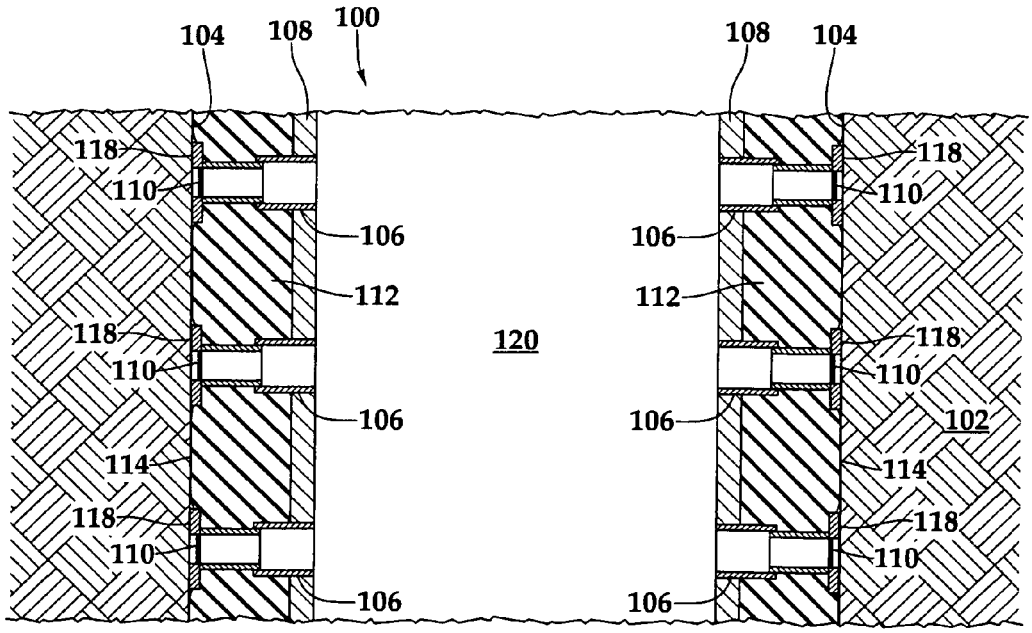
FIG. 6 is a side view of a sand control screen assembly in an operating configuration according to an embodiment of the present invention.

Referring additionally to FIG. 6, therein is depicted a cross sectional view of sand control screen assembly 100 in its operating configuration. The swellable material 112 has come in contact with an activating fluid, such as a hydrocarbon fluid, that has caused swellable material 112 to radially expand into contact with the surface 104 of the formation 102. Likewise, the radial expansion of swellable material 112 has caused telescoping perforations 106 to radially outwardly extend into contact with the surface 104 of the formation 102. In this embodiment, filter medium 110 does not come into contact with the surface 104 of the formation 102 due to a stand off region of face plate 118. Preferably, the outer surface 114 of the swellable material 112 does contact the surface 104 of the formation 102.

Figure 7A:
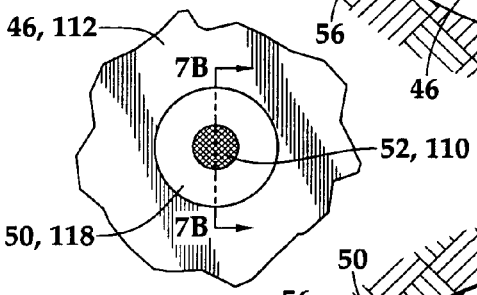
FIG. 7A is a side view of a portion of a sand control screen assembly depicting the top of a telescoping perforation according to an embodiment of the present invention.

Referring additionally to FIG. 7A, therein is depicted a distal end view of a portion of swellable material 46, 112, a face plate 50, 118 and a filter media 52, 110 of a sand control screen assembly 40, 100. As illustrated, face plate 50, 118 is positioned on the exterior surface of swellable material 46, 112 (see also FIGS. 3-6). As swellable material 46, 112 surrounds the telescoping portions of telescoping perforations 48, 106 and as face plates 50, 118 have a diameter that is larger than the diameter of the telescoping portions of telescoping perforations 48, 106, radial expansion of the swellable material 46, 112 applies a radially outwardly directed force on face plates 50, 118 which in turn causes telescoping perforations 48, 106 to radially extend toward the surface 58, 104 of the formation 54, 102.

Figure 7B:
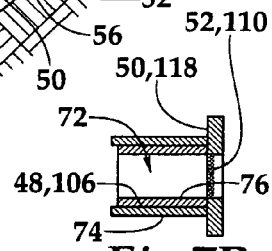
FIG. 7B is a cross sectional view taken along line 7B-7B of the telescoping perforation of FIG. 7A.

Referring to FIG. 7B, telescoping perforation 48, 106 has an outer tubular element 74 and an inner tubular element 76. Preferably, outer tubular element 74 is connected to the base pipe 44, 108 by threading or other suitable means. Inner tubular element 76 is connected to face plate 50, 118. In this manner, when the radially outwardly directed force is applied to face plate 50, 118, inner tubular element 76 telescopes radially outwardly relative to outer tubular element 74. Together, inner and outer tubular elements 74, 76 of telescoping perforation 48, 106 defines an internal flow path 72. Positioned within internal flow path 72 is the filter media 52, 110 which may be a mechanical screening element or other suitable filter member that is sized according to the particular requirements of the production zone into which it will be installed. Some exemplary sizes of the filter media 52 may be 20, 30, and 40 standard mesh sizes.

Even though FIGS. 3-7B have depicted telescoping perforations 48, 106 as having inner and outer tubular elements 74, 76, it should be understood by those skilled in the art that other configurations of nested telescoping elements could alternatively be used in telescoping perforations 48, 106 without departing from the principles of the present invention. In addition, it should be noted that any number of telescoping perforations 48, 106 may be located on base pipe 44, 108 and they may be positioned at any desirable location on the circumference of base pipe 44, 108.

Preferably, when telescoping perforations 48, 106 are fully extended, a stand off distance remains between the filter media 52, 110 and the surface 58, 104 of the formation 54, 102. For example, if a filter cake has previously formed on the surface 58, 104 of the formation 54, 102, then the stand off will prevent damage to the filter media 52, 110 and allow removal of the filter cake using acid or other reactive fluid.

Figure 8:
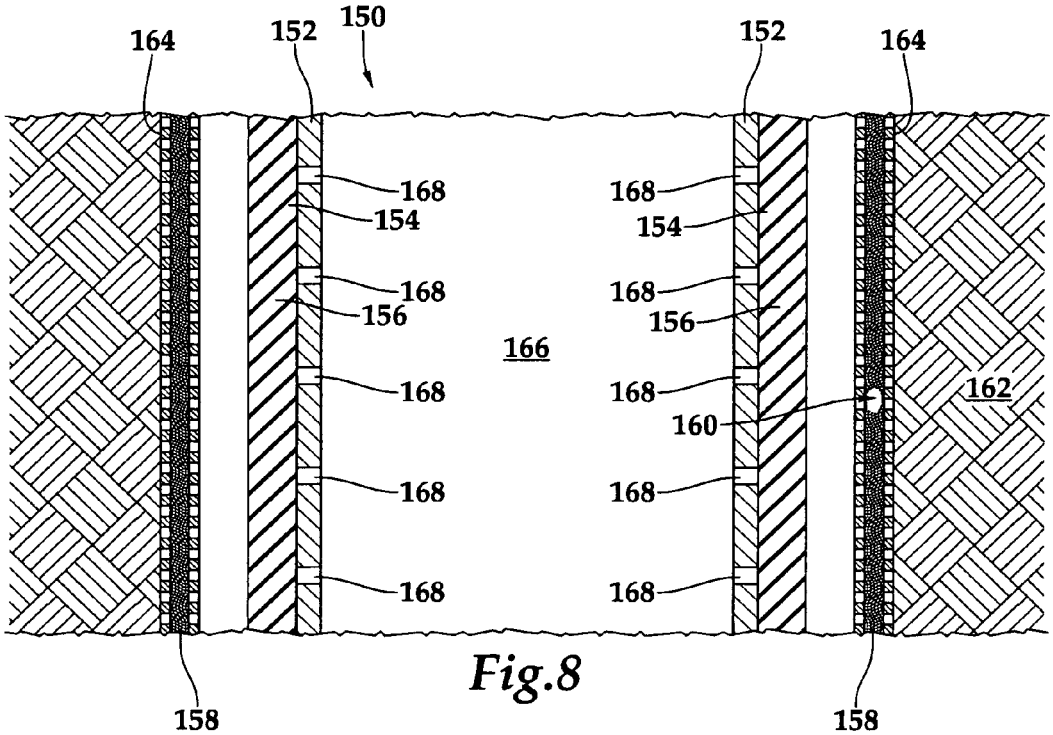
FIG. 8 is a side view of a sand control screen assembly in a run in configuration according to an embodiment of the present invention.

Referring to FIG. 8, therein is depicted a side view of a sand control screen assembly 150 in an unextended position. The sand control screen assembly 150 includes a concentric layer of swellable material 154 that circumferentially surrounds a base pipe 152 having an interior flow path 166. The base pipe 152 preferably includes a plurality of openings 168 that are in fluid communication with the swellable material 154 for providing a fluid conduit between the formation 162 and the interior flow path 166. In the illustrated embodiment, an expandable control screen 158 was previously installed in the open hole completion such that expandable control screen 158 is positioned against the surface 164 of the formation 162. Expandable sand screen 158 is a fluid-porous, particulate restricting, metal material such as a plurality of layers of a wire mesh that may be diffusion bonded or sintered together to form a fluid porous wire mesh screen. Expandable sand screen 158, includes inner and outer tubulars that protect the filter media. As shown, expandable sand screen 158 has an open section 160 where the screen has been worn through or damaged, which allows sand production into the wellbore.

Figure 9:
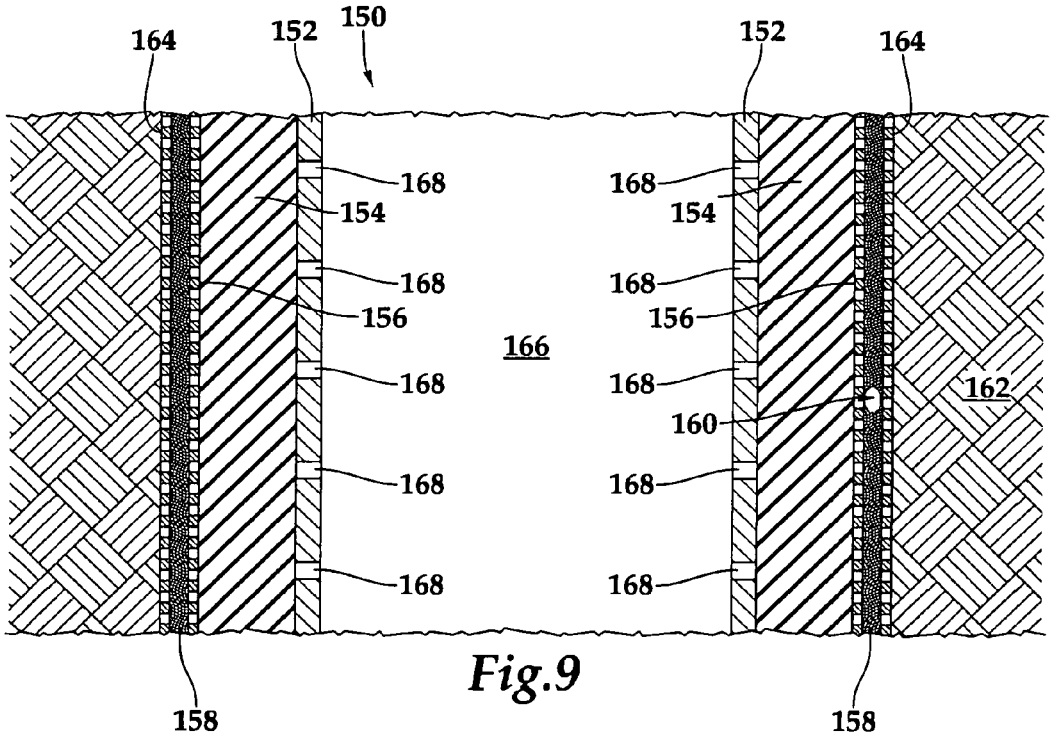
FIG. 9 is a side view of a sand control screen assembly in an operating configuration according to an embodiment of the present invention.

Referring additionally to FIG. 9, therein is depicted a side view of sand control screen assembly 150 in an extended position. Specifically, the swellable material 154 has expanded such that the outer surface 156 of swellable material 154 contacts the inner surface of sand screen 158. This expansion has occurred in response to swellable material 154 contacting an activating fluid, such as a hydrocarbon fluid, as described herein. As shown, the open section 160 of expandable sand screen 158 is now isolated such that sand production through open section 160 is now prevented and the failed section of expandable sand screen 158 is repaired. As such, in embodiments in which swellable material 154 is not permeable, sand control screen assembly 150 may be placed down hole as a patch inside the damaged sand screen 158. Alternatively, in embodiments in which swellable material 154 is fluid permeable but particulate resistant, production fluid may pass through swellable material 154 and openings 168 of base pipe 152 into interior flow path 166.

Figure 10:
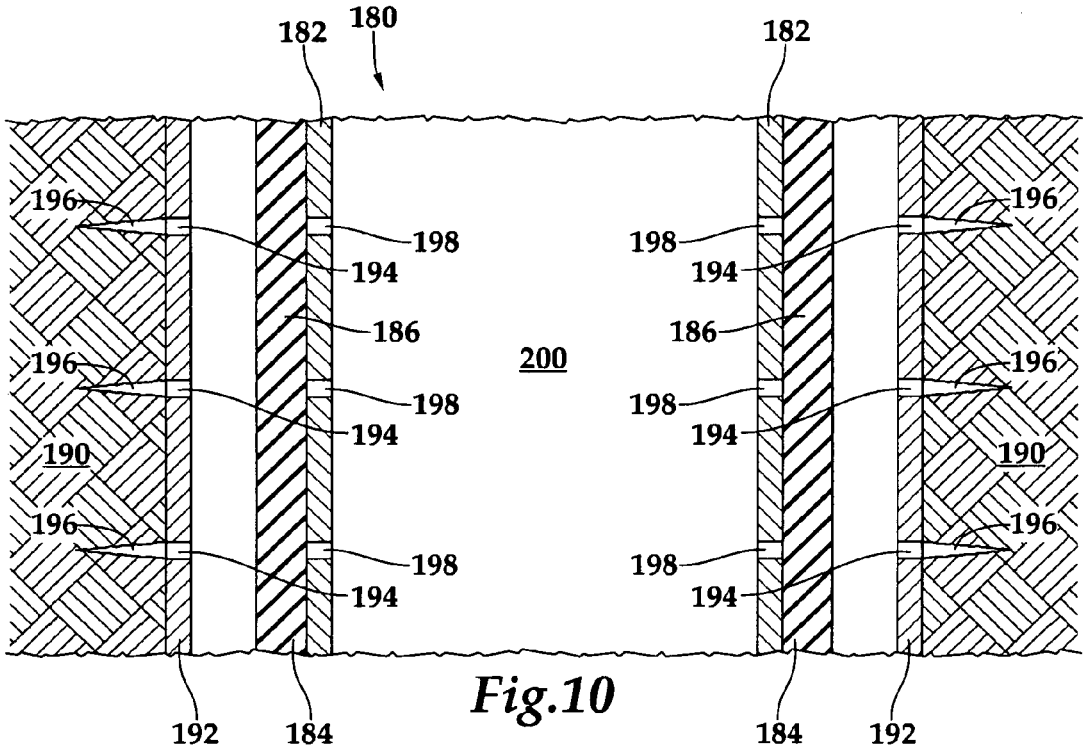
FIG. 10 is a side view of a sand control screen assembly in a run in configuration according to an embodiment of the present invention.
Figure 11:
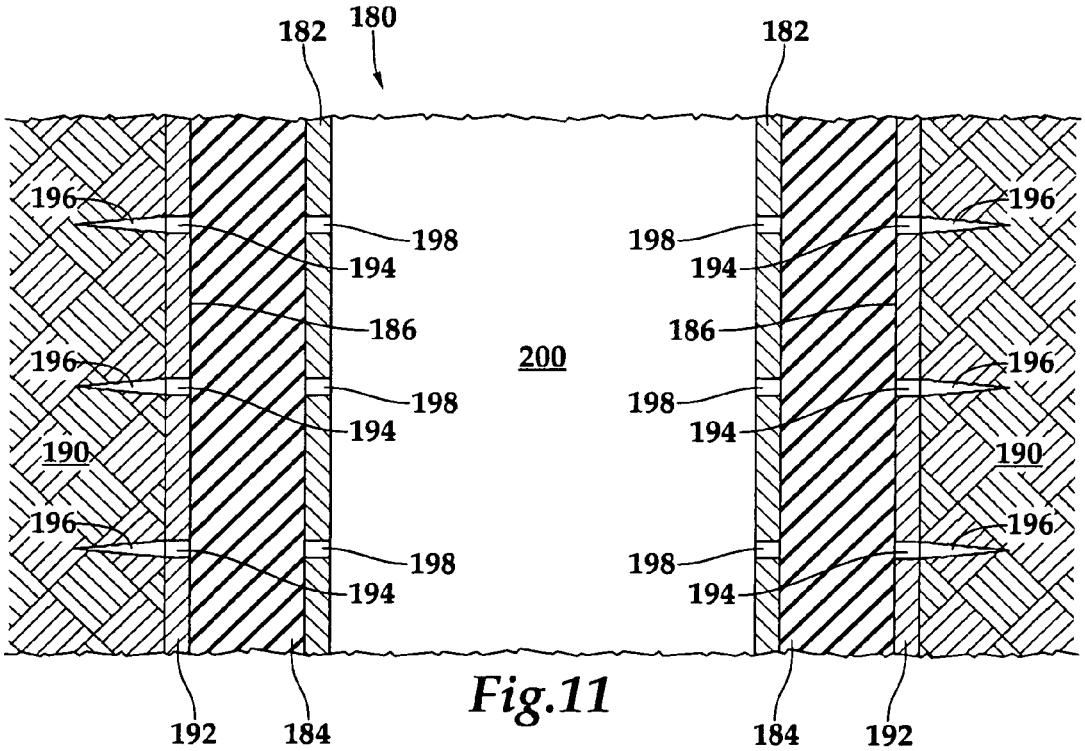
FIG. 11 is a side view of a sand control screen assembly in an operating configuration according to an embodiment of the present invention.

Referring to FIGS. 10-11, therein is depicted a side view of a sand control screen assembly 180 in an unextended and an extended position, respectively. In the illustrated embodiment, sand control screen assembly 180 is positioned in a cased wellbore adjacent to formation 190. Casing 192 has previously been perforated as indicated at 196 which created a plurality of openings 194 through casing 192. Sand control screen assembly 180 includes a concentric layer of swellable material 184 that circumferentially surrounds the base pipe 182. Base pipe 182 includes a plurality of openings 198 and defines an interior flow path 200. As seen in FIG. 11, the swellable material 184 has expanded such that the outer surface 186 of swellable material 184 contact the inner surface of casing 192. This expansion has occurred in response to swellable material 184 contacting an activating fluid, such as a hydrocarbon fluid, as described herein. In the illustrated embodiment, the swellable material 184 may serve as a packer to prevent fluid production and particulate production from the interval associated with casing 192. Alternatively, swellable material 184 may be fluid permeable and particulate resistant such that production fluid may pass through swellable material 184 and openings 198 of base pipe 182 into interior flow path 200.

The above described swellable materials such as swellable materials 46, 112, 154, 184 are materials that swells when contacted by an activating fluid, such as an inorganic or organic fluid. In one embodiment, the swellable material is a material that swells upon contact with and/or absorption of a hydrocarbon, such as oil. In another embodiment, the swellable material is a material that swells upon contact with and/or absorption of an aqueous fluid. The hydrocarbon is absorbed into the swellable material such that the volume of the swellable material increases creating a radial expansion of the swellable material when positioned around a base pipe which creates a radially outward directed force that may operate to radially extend telescoping perforations as described above. Preferably, the swellable material will swell until its outer surface contacts the formation face in an open hole completion or the casing wall in a cased wellbore. The swellable material accordingly provides the energy to extend the telescoping perforations to the surface of the formation.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swell in contact with and by absorption of hydrocarbons so that the swellable material expands. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil. Other swellable materials that behave in a similar fashion with respect to hydrocarbon fluids or aqueous fluids also may be suitable. Those of ordinary skill in the art, with the benefit of this disclosure, will be able to select an appropriate swellable material for use in the present invention based on a variety of factors, including the desired swelling characteristics of the swellable material.

In some embodiments, the activating fluid may. comprise a hydrocarbon fluid or an aqueous fluid. In addition, an activating fluid may comprise additional additives such as weighting agents, acids, acid-generating compounds, and the like, or any other. additive that does not adversely affect the activating fluid or swellable material in which in may come into contact with. For instance, it may be desirable to include an acid and/or an acid-generating compound to at least partially degrade any filter cake that may be present within a wellbore. One of ordinary skill in the art, with the benefit of this disclosure, will recognize that the compatibility of any given additive should be tested to ensure that it does not adversely affect the performance of the activating fluid or the swellable material.

In some embodiments, the swellable materials may be permeable to certain fluids but prevent particulate movement therethrough due to the porosity within the swellable materials. For example, the swellable material may have a pore size that is sufficiently small to prevent the passage of the sand therethrough but sufficiently large to allow hydrocarbon fluid production therethrough. For example, the swellable material may have a pore size of less than 1 mm.

Figure 12:
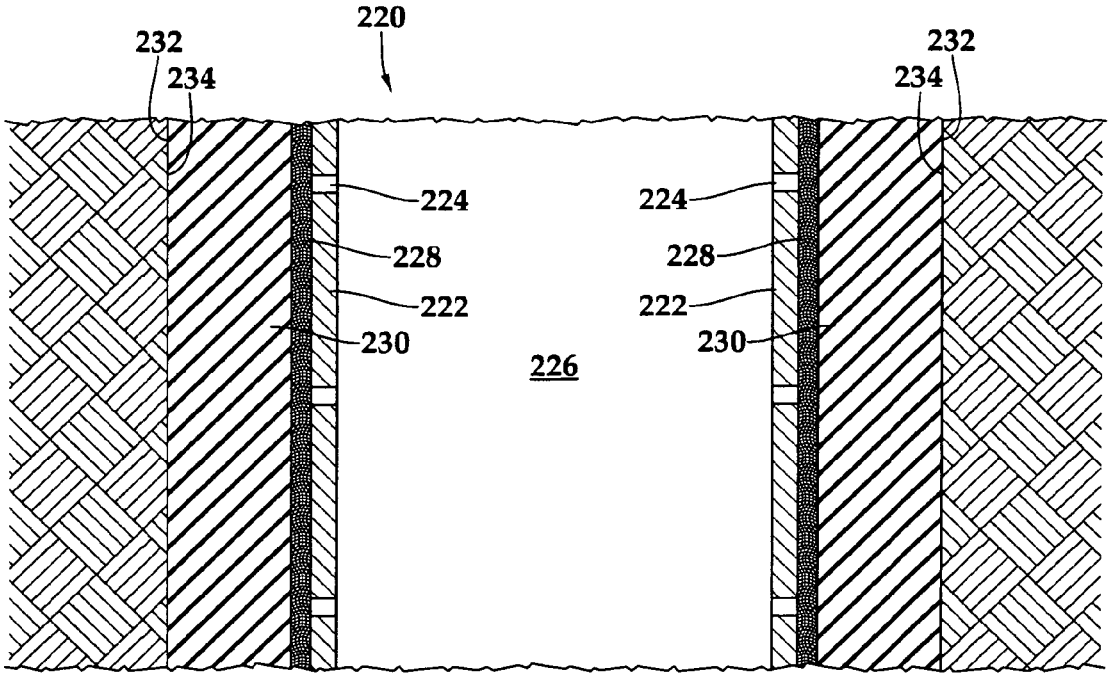
FIG. 12 is a side view of a sand control screen assembly in an operating configuration according to an embodiment of the present invention.

Referring to FIG. 12, therein is depicted a side view of a sand control screen assembly 220 in an expanded configuration. Sand control screen assembly 220 includes a base pipe 222 that has a plurality of openings 224 and defines an interior flow path 226. Positioned concentrically around base pipe 222 is a filter medium 228. Filter medium 228 is depicted as a fluid-porous, particulate restricting, metal material such as a plurality of layers of a wire mesh that may be diffusion bonded or sintered together to form a fluid porous wire mesh screen. Those skilled in the art will understand that other types of filter media could alternatively be used in sand control screen assembly 220 such as a wire wrap screen, a sand packed screen or the like. Sand control screen assembly 220 also includes a layer of swellable material 230 that circumferentially surrounds filter medium 228. Collectively, filter medium 228 and swellable material 230 may be referred to as a swellable filter media.

In a manner similar to that described above, sand control screen assembly 220 is run downhole with swellable material 230 in its unexpanded configuration. As seen in FIG. 12, the swellable material 230 has expanded such that the outer surface 232 of swellable material 230 contacts the surface of the open hole wellbore 234. This expansion has occurred due to swellable material 230 contacting an activating fluid such as a hydrocarbon fluid as described herein. In the illustrated embodiment, the swellable material 230 is permeable to fluids and, in some embodiments, permeable to certain particulate materials which are prevented from entering the interior flow path 226 of base pipe 222 by filter media 228.

Figure 13:
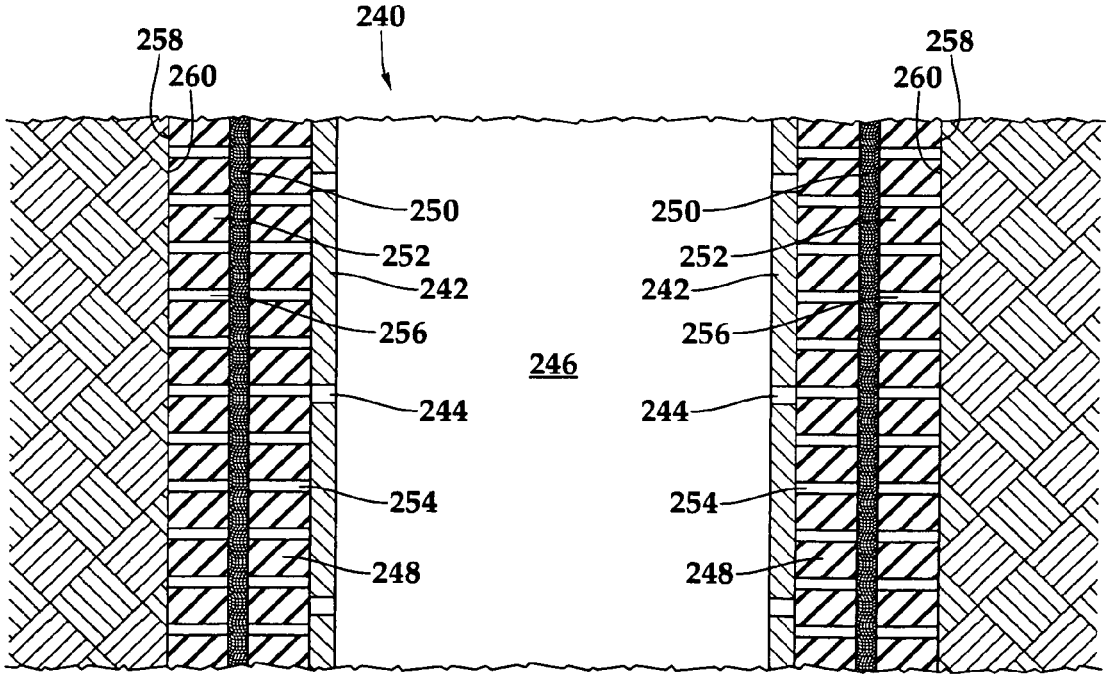
FIG. 13 is a side view of a sand control screen assembly in an operating configuration according to an embodiment of the present invention.

Referring to FIG. 13, therein is depicted a side view of a sand control screen assembly 240 in an expanded configuration. Sand control screen assembly 240 includes a base pipe 242 that has a plurality of openings 244 and defines an interior flow path 246. Positioned concentrically around base pipe 242 is a layer of swellable material 248. Positioned concentrically around swellable material 248 is a filter medium 250. Filter medium 250 is depicted as a fluid-porous, particulate restricting, metal material such as a plurality of layers of a wire mesh that may be diffusion bonded or sintered together to form a fluid porous wire mesh screen. Those skilled in the art will understand that other types of filter media could alternatively be used in sand control screen assembly 220 such as a wire wrap screen, sand packed screen or the like.

Sand control screen assembly 240 also includes a layer of swellable material 252 that circumferentially surrounds filter medium 250. Swellable material 248 includes a plurality of perforations 254 and swellable material 252 includes a plurality of perforations 256. Collectively, filter medium 250 and swellable materials 248, 252 may be referred to as a swellable filter media.

In a manner similar to that described above, sand control screen assembly 240 is run downhole with swellable materials 248, 252 in their unexpanded configuration. As seen in FIG. 13, swellable materials 248, 252 have expanded such that the outer surface 258 of swellable material 252 contacts the surface of the open hole wellbore 260. This expansion has occurred due to swellable materials 248, 252 contacting an activating fluid such as a hydrocarbon fluid as described herein.

Figure 14:
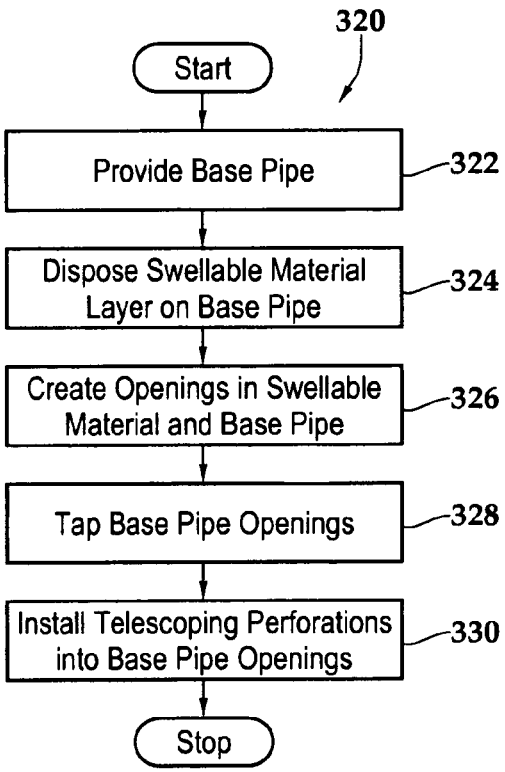
FIG. 14 is a flow diagram of a process for making a sand control screen assembly according to an embodiment of the present invention.

In addition to the aforementioned aspects and embodiments of the present sand control screen assemblies, the present invention further includes methods for making a sand control screen assembly. FIG. 14 illustrates an embodiment 320 of an exemplary process for making a sand control screen assembly. In step 322, a base pipe is provided of a desired length for use in a desired application. In step 324, a coating of swellable material is disposed on the exterior of the base pipe. This step may include any type of application process appropriate for the swellable materials disclosed herein, including: dipping, spraying, wrapping, applying and the like. Generally, the swellable material is applied in a desired length on the base pipe according to the desired application in the wellbore. Also, the location of the swellable material on the base pipe may be determined by where the base pipe will be in the wellbore in relation to the production areas.

In step 326, openings are created in the swellable material. This step may be performed by removing those portions of the swellable material by drilling, cutting and the like. In this step, corresponding portions of the base pipe may also be removed to create holes in the base pipe using the same or a different drilling or cutting process.

In step 328, the holes in the base pipe may be tapped or threaded for acceptance of the telescoping perforations. In step 330, the telescoping perforations, including face plates, are installed through the removed portions of the swellable material and threaded into the tapped holes of the base pipe to complete the sand control screen assembly.

Figure 15:
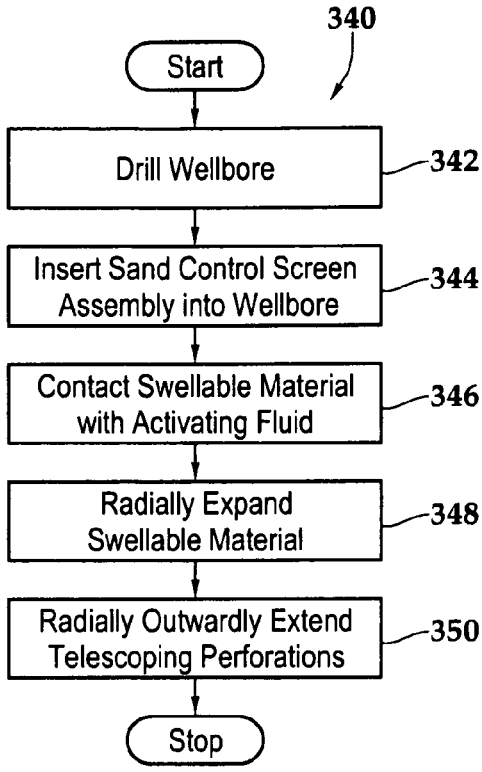
FIG. 15 is a flow diagram of a process for installing and operating a sand control screen assembly according to an embodiment of the present invention.

FIG. 15 illustrates an embodiment 340 of an exemplary process for controlling sand and hydrocarbon production from a production interval. In step 342, a wellbore is drilled such that is traverses a subterranean hydrocarbon bearing formation. This step may include placing various casings or liners in the wellbore and performing various other well construction activities prior to insertion of the work string including one or more sand control screen assemblies of the present invention. In step 344, one or more sand control screen assemblies are inserted into the wellbore and the sand control screen assemblies are positioned adjacent to their respective production intervals. In this step, the sand control screen assemblies are preferably run into a hole with a smooth inner bore and smooth outer bore to minimize the risk of getting stuck.

In step 346, an activating fluid, such as a hydrocarbon, contacts the sand control screen assemblies and they expand, extend and/or swell radially outwards to come in contact with the surface of the formation of the wellbore. In those embodiments including telescoping perforations, steps 348 and 350 involve radially expanding the swellable material of the sand control screen assemblies which creates a outward radial force on the face plates such that telescoping perforations radially extend.

At this point, the wellbore is highly suitable for post treatment stimulation as there are no restrictions inside the wellbore. Further, it is not necessary to pump gravel or cement to achieve effective zone isolation and sand control. As described above, this process may further include incorporating blank packers, including swell packers, in the work string to further isolate desired sections of the wellbore making it possible to complete long, heterogeneous intervals.

The available flow area can be regulated by the density and size of the telescoping perforations used. In any of the steps above, packers may be set up to run control lines or fiber optics. Thus, it may be further configured to include fiber optics for continuous temperature and pressure monitoring as well as other control lines to perform smart well functions.

As previously mentioned, the methods of the present invention also include the introduction of a consolidating agent into at least a portion of the subterranean formation. As used herein, the term "consolidating agent" refers to a composition that enhances the grain-to-grain (or grain-to-formation) contact between particulates (e.g., proppant particulates, gravel particulates, formation fines, coal fines, etc.) within a portion of the subterranean formation so that the particulates are stabilized, locked in place, or at least partially immobilized such that they are resistant to flowing with fluids. In one embodiment, the consolidating agent may be introduced into the portion of the subterranean formation after the placement of the sand control screen assembly in the wellbore. In another embodiment, the consolidating agent may be introduced into the portion of the subterranean formation after the activating fluid has come into contact with a sand control screen assembly, so that the swellable material layer of a sand control screen assembly has radially outwardly extended.

The consolidating agents suitable for use in the methods of the present invention generally comprise any compound that is capable of minimizing particulate migration. In some embodiments, the consolidating agent may comprise a consolidating agent chosen from the group consisting of: non-aqueous tackifying agents; aqueous tackifying agents; resins; silyl-modified polyamide compounds; and consolidating agent emulsions. Combinations of these also may be suitable.

The type and amount of consolidating agent included in a particular method of the invention may depend upon, among other factors, the composition and/or temperature of the subterranean formation, the chemical composition of formations fluids, the flow rate of fluids present in the formation, the effective porosity and/or permeability of the subterranean formation, pore throat size and distribution, and the like. Furthermore, the concentration of the consolidating agent can be varied, inter alia, to either enhance bridging to provide for a more rapid coating of the consolidating agent or to minimize bridging to allow deeper penetration into the subterranean formation. It is within the ability of one skilled in the art, with the benefit of this disclosure, to determine the type and amount of consolidating agent to include in the methods of the present invention to achieve the desired results.

The consolidating agents suitable for use in the methods of the present invention may be provided in any suitable form, including in a particle form, which may be in a solid form and/or a liquid form. In those embodiments where the consolidating agent is provided in a particle form, the size of the particle can vary widely. In some embodiments, the consolidating agent particles may have an average particle diameter of about 0.01 micrometers ("μm") to about 300 μm. In some embodiments, the consolidating agent particles may have an average particle diameter of about 0.01 μm to about 100 μm. In some embodiments, the consolidating agent particles may have an average particle diameter of about 0.01 μm to about 10 μm. The size distribution of the consolidating agent particles used in a particular composition or method of the invention may depend upon several factors, including, but not limited to, the size distribution of the particulates present in the subterranean formation, the effective porosity and/or permeability of the subterranean formation, pore throat size and distribution, and the like.

In some embodiments, it may be desirable to use a consolidating agent particle with a size distribution such that the consolidating agent particles are placed at contact points between formation particulates. For example, in some embodiments, the size distribution of the consolidating agent particles may be within a smaller size range, e.g., of about 0.01 μm to about 10 μm. It may be desirable in some embodiments to provide consolidating agent particles with a smaller particle size distribution, inter alia, to promote deeper penetration of the consolidating agent particles through a body of unconsolidated particulates or in low permeability formations.

In other embodiments, the size distribution of the consolidating agent particles may be within a larger range, e.g. of about 30 μm to about 300 μm. It may be desirable in some embodiments to provide consolidating agent particles with a larger particle size distribution, inter alia, to promote the filtering out of consolidating agent particles at or near the spaces between neighboring unconsolidated particulates or in high permeability formations. A person of ordinary skill in the art, with the benefit of this disclosure, will be able to select an appropriate particle size distribution for the consolidating agent particles suitable for use in the present invention and will appreciate that methods of creating consolidating agent particles of any relevant size are well known in the art.

In some embodiments of the present invention, the consolidating agent may comprise a non-aqueous tackifying agent. A particularly preferred group of non-aqueous tackifying agents comprises polyamides that are liquids or in solution at the temperature of the subterranean formation such that they are, by themselves, nonhardening when introduced into the subterranean formation. A particularly preferred product is a condensation reaction product comprised of a commercially available polyacid and a polyamine. Such commercial products include compounds such as combinations of dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Combinations of these may be suitable as well. Such acid compounds are commercially available from companies such as Union Camp, Chemtall, and Emery Industries. The reaction products are available from, for example, Champion Technologies, Inc.

Additional compounds which may be used as non-aqueous tackifying agents include liquids and solutions of, for example, polyesters, polycarbonates, silyl-modified polyamide compounds, polycarbamates, urethanes, natural resins such as shellac, and the like. Combinations of these may be suitable as well.

Other suitable non-aqueous tackifying agents are described in U.S. Pat. Nos. 5,853,048 and 5,833,000, both issued to Weaver, et al., and U.S. Patent Publication Nos. 2007/0131425 and 2007/0131422, the disclosures of which are herein incorporated by reference.

Non-aqueous tackifying agents suitable for use in the present invention may either be used such that they form a nonhardening coating on a surface or they may be combined with a multifunctional material capable of reacting with the non-aqueous tackifying agent to form a hardened coating. A "hardened coating" as used herein means that the reaction of the tackifying compound with the multifunctional material should result in a substantially non-flowable reaction product that exhibits a higher compressive strength in a consolidated agglomerate than the tackifying compound alone with the particulates. In this instance, the non-aqueous tackifying agent may function similarly to a hardenable resin.

Multifunctional materials suitable for use in the present invention include, but are not limited to, aldehydes; dialdehydes such as glutaraldehyde; hemiacetals or aldehyde releasing compounds; diacid halides; dihalides such as dichlorides and dibromides; polyacid anhydrides; epoxides; furfuraldehyde; aldehyde condensates; and silyl-modified polyamide compounds; and the like; and combinations thereof. Suitable silyl-modified polyamide compounds that may be used in the present invention are those that are substantially self-hardening compositions capable of at least partially adhering to a surface or to a particulate in the unhardened state, and that are further capable of self-hardening themselves to a substantially non-tacky state to which individual particulates such as formation fines will not adhere to, for example, in formation or proppant pack pore throats. Such silyl-modified polyamides may be based, for example, on the reaction product of a silating compound with a polyamide or a combination of polyamides. The polyamide or combination of polyamides may be one or more polyamide intermediate compounds obtained, for example, from the reaction of a polyacid (e.g., diacid or higher) with a polyamine (e.g., diamine or higher) to form a polyamide polymer with the elimination of water.

In some embodiments of the present invention, the multifunctional material may be mixed with the tackifying compound in an amount of about 0.01% to about 50% by weight of the tackifying compound to effect formation of the reaction product. In other embodiments, the multifunctional material is present in an amount of about 0.5% to about 1% by weight of the tackifying compound. Suitable multifunctional materials are described in U.S. Pat. No. 5,839,510 issued to Weaver, et al., the disclosure of which is herein incorporated by reference.

Aqueous tackifying agents suitable for use in the present invention are usually not generally significantly tacky when introduced into a subterranean formation, but are capable of being "activated" (e.g., destabilized, coalesced and/or reacted) to transform the compound into a sticky, tackifying compound at a desirable time. Such activation may occur before, during, or after the aqueous tackifying agent is placed in the subterranean formation. In some embodiments, a pretreatment may be first introduced into the subterranean formation to prepare it for the placement of an aqueous tackifying agent. Suitable aqueous tackifying agents are generally charged polymers that comprise compounds that, when in an aqueous solvent or solution, will form a nonhardening coating (by itself or with an activator) and, when placed on a particulate, will increase the continuous critical resuspension velocity of the particulate when contacted by a stream of water. The aqueous tackifying agent may enhance the grain-to-grain contact between the individual particulates within the formation (be they proppant particulates, formation fines, or other particulates), helping bring about the consolidation of the particulates into a cohesive, flexible, and permeable mass.

Suitable aqueous tackifying agents include any polymer that can bind, coagulate, or flocculate a particulate. Also, polymers that function as pressure-sensitive adhesives may be suitable. Examples of aqueous tackifying agents suitable for use in the present invention include, but are not limited to: acrylic acid polymers; acrylic acid ester polymers; acrylic acid derivative polymers; acrylic acid homopolymers; acrylic acid ester homopolymers (such as poly(methyl acrylate), poly (butyl acrylate), and poly(2-ethylhexyl acrylate)); acrylic acid ester co-polymers; methacrylic acid derivative polymers; methacrylic acid homopolymers; methacrylic acid ester homopolymers (such as poly(methyl methacrylate), poly(butyl methacrylate), and poly(2-ethylhexyl methacrylate)); acrylamido-methyl-propane sulfonate polymers; acrylamido-methyl-propane sulfonate derivative polymers; acrylamido-methyl-propane sulfonate co-polymers; and acrylic acid/acrylamido-methyl-propane sulfonate co-polymers; derivatives thereof, and combinations thereof. Methods of determining suitable aqueous tackifying agents and additional disclosure on aqueous tackifying agents can be found in U.S. Patent Publication No. 2005/0277554, and U.S. Pat. No. 7,131,491, the disclosures of which are hereby incorporated by reference.

Some suitable tackifying agents are described in U.S. Pat. No. 5,249,627 by Harms, et al., the disclosure of which is incorporated by reference. Harms discloses, inter alia, aqueous tackifying agents that comprise at least one member selected from the group consisting of benzyl coco di-(hydroxyethyl) quaternary amine, p-T-amyl-phenol condensed with formaldehyde, and a copolymer comprising from about 80% to about 100% C1-30 alkylmethacrylate monomers and from about 0% to about 20% hydrophilic monomers. In some embodiments, the aqueous tackifying agent may comprise a copolymer that comprises from about 90% to about 99.5% 2-ethylhexylacrylate and from about 0.5% to about 10% acrylic acid. Suitable hydrophilic monomers may be any monomer that will provide polar oxygen-containing or nitrogen-containing groups. Suitable hydrophilic monomers include dialkyl amino alkyl (meth)acrylates and their quaternary addition and acid salts, acrylamide, N-(dialkyl amino alkyl) acrylamide, methacrylamides and their quaternary addition and acid salts, hydroxy alkyl (meth)acrylates, unsaturated carboxylic acids such as methacrylic acid or acrylic acid, hydroxyethyl acrylate, acrylamide, and the like. Combinations of these may be suitable as well. These copolymers can be made by any suitable emulsion polymerization technique. Methods of producing these copolymers are disclosed, for example, in U.S. Pat. No. 4,670,501, the disclosure of which is incorporated herein by reference.

In some embodiments of the present invention, the consolidating agent may comprise a resin. The term "resin" as used herein refers to any of numerous physically similar polymerized synthetics or chemically modified natural resins including thermoplastic materials and thermosetting materials. Resins that may be suitable for use in the present invention may include substantially all resins known and used in the art.

One type of resin suitable for use in the methods of the present invention is a two-component epoxy-based resin comprising a liquid hardenable resin component and a liquid hardening agent component. The liquid hardenable resin component comprises a hardenable resin and an optional solvent. The solvent may be added to the resin to reduce its viscosity for ease of handling, mixing and transferring. It is within the ability of one skilled in the art, with the benefit of this disclosure, to determine if and how much solvent may be needed to achieve a viscosity suitable to the subterranean conditions. Factors that may affect this decision include geographic location of the well, the surrounding weather conditions, and the desired long-term stability of the consolidating agent. An alternate way to reduce the viscosity of the hardenable resin is to heat it. The second component is the liquid hardening agent component, which comprises a hardening agent, an optional silane coupling agent, a surfactant, an optional hydrolyzable ester for, among other things, breaking gelled fracturing fluid films on proppant particulates, and an optional liquid carrier fluid for, among other things, reducing the viscosity of the hardening agent component.

Examples of hardenable resins that can be used in the liquid hardenable resin component include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and combinations thereof. In some embodiments, the hardenable resin may comprise a urethane resin. Examples of suitable urethane resins may comprise a polyisocyanate component and a polyhydroxy component. Examples of suitable hardenable resins, including urethane resins, that may be suitable for use in the methods of the present invention include those described in U.S. Pat. No. 6,582,819, issued to McDaniel, et al.; U.S. Pat. No. 4,585,064 issued to Graham, et al.; U.S. Pat. No. 6,677,426 issued to Noro, et al.; and U.S. Pat. No. 7,153,575 issued to Anderson, et al., the disclosures of which are herein incorporated by reference.

The hardenable resin may be included in the liquid hardenable resin component in an amount in the range of about 5% to about 100% by weight of the liquid hardenable resin component. It is within the ability of one skilled in the art, with the benefit of this disclosure, to determine how much of the liquid hardenable resin component may be needed to achieve the desired results. Factors that may affect this decision include which type of liquid hardenable resin component and liquid hardening agent component are used.

Any solvent that is compatible with the hardenable resin and achieves the desired viscosity effect may be suitable for use in the liquid hardenable resin component. Suitable solvents may include butyl lactate, dipropylene glycol methyl ether, dipropylene glycol dimethyl ether, dimethyl formamide, diethyleneglycol methyl ether, ethyleneglycol butyl ether, diethyleneglycol butyl ether, propylene carbonate, methanol, butyl alcohol, d'limonene, fatty acid methyl esters, and butylglycidyl ether, and combinations thereof. Other preferred solvents may include aqueous dissolvable solvents such as, methanol, isopropanol, butanol, and glycol ether solvents, and combinations thereof. Suitable glycol ether solvents include, but are not limited to, diethylene glycol methyl ether, dipropylene glycol methyl ether, 2-butoxy ethanol, ethers of a $C_2$ to $C_6$ dihydric alkanol containing at least one $C_1$ to $C_6$ alkyl group, mono ethers of dihydric alkanols, methoxypropanol, butoxyethanol, and hexoxyethanol, and isomers thereof. Selection of an appropriate solvent is dependent on the resin composition chosen and is within the ability of one skilled in the art, with the benefit of this disclosure.

As described above, use of a solvent in the liquid hardenable resin component is optional but may be desirable to reduce the viscosity of the hardenable resin component for ease of handling, mixing, and transferring. However, as previously stated, it may be desirable in some embodiments to not use such a solvent for environmental or safety reasons. It is within the ability of one skilled in the art, with the benefit of this disclosure, to determine if and how much solvent is needed to achieve a suitable viscosity. In some embodiments, the amount of the solvent used in the liquid hardenable resin component may be in the range of about 0.1% to about 30% by weight of the liquid hardenable resin component. Optionally, the liquid hardenable resin component may be heated to reduce its viscosity, in place of, or in addition to, using a solvent.

Examples of the hardening agents that can be used in the liquid hardening agent component include, but are not limited to, cyclo-aliphatic amines, such as piperazine, derivatives of piperazine (e.g., aminoethylpiperazine) and modified piperazines; aromatic amines, such as methylene dianiline, derivatives of methylene dianiline and hydrogenated forms, and 4,4'-diaminodiphenyl sulfone; aliphatic amines, such as ethylene diamine, diethylene triamine, triethylene tetraamine, and tetraethylene pentaamine; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; and 2-ethyl-4-methyl imidazole; and combinations thereof. The chosen hardening agent often effects the range of temperatures over which a hardenable resin is able to cure. By way of example, and not of limitation, in subterranean formations having a temperature of about 60° F. to about 250° F., amines and cyclo-aliphatic amines such as piperidine, triethylamine, tris(dimethylaminomethyl) phenol, and dimethylaminomethyl)phenol may be preferred. In subterranean formations having higher temperatures, 4,4'-diaminodiphenyl sulfone may be a suitable hardening agent. Hardening agents that comprise piperazine or a derivative of piperazine have been shown capable of curing various hardenable resins from temperatures as low as about 50° F. to as high as about 350° F.

The hardening agent used may be included in the liquid hardening agent component in an amount sufficient to at least partially harden the resin composition. In some embodiments of the present invention, the hardening agent used is included in the liquid hardening agent component in the range of about 0.1% to about 95% by weight of the liquid hardening agent component. In other embodiments, the hardening agent used may be included in the liquid hardening agent component in an amount of about 15% to about 85% by weight of the liquid hardening agent component. In other embodiments, the hardening agent used may be included in the liquid hardening agent component in an amount of about 15% to about 55% by weight of the liquid hardening agent component.

In some embodiments, the consolidating agent may comprise a liquid hardenable resin component emulsified in a liquid hardening agent component, wherein the liquid hardenable resin component is the internal phase of the emulsion and the liquid hardening agent component is the external phase of the emulsion. In other embodiments, the liquid hardenable resin component may be emulsified in an aqueous fluid, such as water, and the liquid hardening agent component may be present in the aqueous fluid. In other embodiments, the liquid hardenable resin component may be emulsified in an aqueous fluid and the liquid hardening agent component may be provided separately. Similarly, in other embodiments, both the liquid hardenable resin component and the liquid hardening agent component may both be emulsified in an aqueous fluid.

The optional silane coupling agent may be used, among other things, to act as a mediator to help bond the resin to formation particulates or proppant particulates. Examples of suitable silane coupling agents include, but are not limited to, N-2-(aminoethyl)-3-aminopropyltrimethoxysilane, and 3-glycidoxypropyltrimethoxysilane, and combinations thereof. The silane coupling agent may be included in the resin component or the liquid hardening agent component (according to the chemistry of the particular group as determined by one skilled in the art with the benefit of this disclosure). In some embodiments of the present invention, the silane coupling agent used is included in the liquid hardening agent component in the range of about 0.1% to about 3% by weight of the liquid hardening agent component.

Any surfactant compatible with the hardening agent may be used in the liquid hardening agent component. Such surfactants include, but are not limited to, an alkyl phosphonate surfactant (e.g., a $C_{12}$-$C_{22}$ alkyl phosphonate surfactant), an ethoxylated nonyl phenol phosphate ester, one or more cationic surfactants, and one or more nonionic surfactants. Combinations of one or more cationic and nonionic surfactants also may be suitable. Examples of such surfactant combinations are described in U.S. Pat. No. 6,311,773 issued to Todd et al., the disclosure of which is incorporated herein by reference. The surfactant or surfactants that may be used are included in the liquid hardening agent component in an amount in the range of about 1% to about 10% by weight of the liquid hardening agent component.

While not required, examples of hydrolyzable esters that may be used in the liquid hardening agent component include, but are not limited to, a combination of dimethylglutarate, dimethyladipate, and dimethylsuccinate; dimethylthiolate; methyl salicylate; dimethyl salicylate; and dimethylsuccinate; and combinations thereof. When used, a hydrolyzable ester is included in the liquid hardening agent component in an amount in the range of about 0.1% to about 3% by weight of the liquid hardening agent component. In some embodiments a hydrolyzable ester is included in the liquid hardening agent component in an amount in the range of about 1% to about 2.5% by weight of the liquid hardening agent component.

Use of a diluent or liquid carrier fluid in the liquid hardening agent component is optional and may be used to reduce the viscosity of the liquid hardening agent component for ease of handling, mixing, and transferring. As previously stated, it may be desirable in some embodiments to not use such a solvent for environmental or safety reasons. Any suitable carrier fluid that is compatible with the liquid hardening agent component and achieves the desired viscosity effects is suitable for use in the present invention. Some suitable liquid carrier fluids are those having high flash points (e.g., about 125° F.) because of, among other things, environmental and safety concerns; such solvents include, but are not limited to, butyl lactate, dipropylene glycol methyl ether, dipropylene glycol dimethyl ether, dimethyl formamide, diethyleneglycol methyl ether, ethyleneglycol butyl ether, diethyleneglycol butyl ether, propylene carbonate, methanol, butyl alcohol, d'limonene, and fatty acid methyl esters, and combinations thereof. Other suitable liquid carrier fluids include aqueous dissolvable solvents such as, for example, methanol, isopropanol, butanol, glycol ether solvents, and combinations thereof. Suitable glycol ether liquid carrier fluids include, but are not limited to, diethylene glycol methyl ether, dipropylene glycol methyl ether, 2-butoxy ethanol, ethers of a $C_2$ to $C_6$ dihydric alkanol having at least one $C_1$ to $C_6$ alkyl group, mono ethers of dihydric alkanols, methoxypropanol, butoxyethanol, and hexoxyethanol, and isomers thereof. Combinations of these may be suitable as well. Selection of an appropriate liquid carrier fluid is dependent on, inter alia, the resin composition chosen.

Other resins suitable for use in the present invention are furan-based resins. Suitable furan-based resins include, but are not limited to, furfuryl alcohol resins, furfural resins, combinations of furfuryl alcohol resins and aldehydes, and a combination of furan resins and phenolic resins. Of these, furfuryl alcohol resins may be preferred. A furan-based resin may be combined with a solvent to control viscosity if desired. Suitable solvents for use in the furan-based consolidation fluids of the present invention include, but are not limited to, 2-butoxy ethanol, butyl lactate, butyl acetate, tetrahydrofurfuryl methacrylate, tetrahydrofurfuryl acrylate, esters of oxalic, maleic and succinic acids, and furfuryl acetate. Of these, 2-butoxy ethanol is preferred. In some embodiments, the furan-based resins suitable for use in the present invention may be capable of enduring temperatures well in excess of 350° F. without degrading. In some embodiments, the furan-based resins suitable for use in the present invention are capable of enduring temperatures up to about 700° F. without degrading.

Optionally, the furan-based resins suitable for use in the present invention may further comprise a curing agent, inter alia, to facilitate or accelerate curing of the furan-based resin at lower temperatures. The presence of a curing agent may be particularly useful in embodiments where the furan-based resin may be placed within subterranean formations having temperatures below about 350° F. Examples of suitable curing agents include, but are not limited to, organic or inorganic acids, such as, inter alia, maleic acid, fumaric acid, sodium bisulfate, hydrochloric acid, hydrofluoric acid, acetic acid, formic acid, phosphoric acid, sulfonic acid, alkyl benzene sulfonic acids such as toluene sulfonic acid and dodecyl benzene sulfonic acid ("DDBSA"), and combinations thereof. In those embodiments where a curing agent is not used, the furan-based resin may cure autocatalytically.

Still other resins suitable for use in the methods of the present invention are phenolic-based resins. Suitable phenolic-based resins include, but are not limited to, terpolymers of phenol, phenolic formaldehyde resins, and a combination of phenolic and furan resins. In some embodiments, a combination of phenolic and furan resins may be preferred. A phenolic-based resin may be combined with a solvent to control viscosity if desired. Suitable solvents for use in the present invention include, but are not limited to butyl acetate, butyl lactate, furfuryl acetate, and 2-butoxy ethanol. Of these, 2-butoxy ethanol may be preferred in some embodiments.

Yet another resin-type material suitable for use in the methods of the present invention is a phenol/phenol formaldehyde/furfuryl alcohol resin comprising of about 5% to about 30% phenol, of about 40% to about 70% phenol formaldehyde, of about 10% to about 40% furfuryl alcohol, of about 0.1% to about 3% of a silane coupling agent, and of about 1% to about 15% of a surfactant. In the phenol/phenol formaldehyde/furfuryl alcohol resins suitable for use in the methods of the present invention, suitable silane coupling agents include, but are not limited to, N2-(aminoethyl)-3-aminopropyltrimethoxysilane, and 3-glycidoxypropyltrimethoxysilane. Suitable surfactants include, but are not limited to, an ethoxylated nonyl phenol phosphate ester, combinations of one or more cationic surfactants, and one or more nonionic surfactants and an alkyl phosphonate surfactant.

In some embodiments, consolidating agents suitable for use in the methods of the present invention may optionally comprise filler particles. Suitable filler particles may include any particle that does not adversely react with the other components used in accordance with this invention or with the subterranean formation. Examples of suitable filler particles include silica, glass, clay, alumina, fumed silica, carbon black, graphite, mica, meta-silicate, calcium silicate, calcine, kaoline, talc, zirconia, titanium dioxide, fly ash, and boron, and combinations thereof. In some embodiments, the filler particles may range in size of about 0.01 μm to about 100 μm. As will be understood by one skilled in the art, particles of smaller average size may be particularly useful in situations where it is desirable to obtain high proppant pack permeability (i.e., conductivity), and/or high consolidation strength. In certain embodiments, the filler particles may be included in the consolidating agent in an amount of about 0.1% to about 70% by weight of the consolidating agent. In other embodiments, the filler particles may be included in the consolidating agent in an amount of about 0.5% to about 40% by weight of the consolidating agent. In some embodiments, the filler particles may be included in the consolidating agent in an amount of about 1% to about 10% by weight of the consolidating agent. Some examples of suitable consolidating agent compositions comprising filler particles are described in U.S. Patent Publication No. 2008/0006405, issued to Rickman, et al., the disclosure of which is herein incorporated by reference.

Silyl-modified polyamide compounds may be described as substantially self-hardening compositions that are capable of at least partially adhering to particulates in the unhardened state, and that are further capable of self-hardening themselves to a substantially non-tacky state to which individual particulates such as formation fines will not adhere to, for example, in formation or proppant pack pore throats. Such silyl-modified polyamides may be based, for example, on the reaction product of a silating compound with a polyamide or a combination of polyamides. The polyamide or combination of polyamides may be one or more polyamide intermediate compounds obtained, for example, from the reaction of a polyacid (e.g., diacid or higher) with a polyamine (e.g., diamine or higher) to form a polyamide polymer with the elimination of water. Other suitable silyl-modified polyamides and methods of making such compounds are described in U.S. Pat. No. 6,439,309, issued to Matherly, et al., the disclosure of which is herein incorporated by reference.

Other suitable consolidating agents are described in U.S. Pat. Nos. 6,196,317, 6,192,986 and 5,836,392, the disclosures of which are incorporated by reference herein.

In other embodiments, the consolidating agent may comprise a consolidating agent emulsion that comprises an aqueous fluid, an emulsifying agent, and a consolidating agent. The consolidating agent in suitable emulsions may be either a nonaqueous tackifying agent or a resin, such as those described above. These consolidating agent emulsions have an aqueous external phase and organic-based internal phase. The term "emulsion" and any derivatives thereof as used herein refers to a combination of two or more immiscible phases and includes, but is not limited to, dispersions and suspensions.

Suitable consolidating agent emulsions comprise an aqueous external phase comprising an aqueous fluid. Suitable aqueous fluids that may be used in the consolidating agent emulsions include freshwater, salt water, brine, seawater, or any other aqueous fluid that, preferably, does not adversely react with the other components used in accordance with this invention or with the subterranean formation. One should note, however, that if long-term stability of the emulsion is desired, a more suitable aqueous fluid may be one that is substantially free of salts. It is within the ability of one skilled in the art, with the benefit of this disclosure, to determine if and how much salt may be tolerated in the consolidating agent emulsion before it becomes problematic for the stability of the emulsion. The aqueous fluid may be present in the consolidating agent emulsions in an amount in the range of about 20% to 99.9% by weight of the consolidating agent emulsion composition. In some embodiments, the aqueous fluid may be present in the consolidating agent emulsions in an amount in the range of about 60% to 99.9% by weight of the consolidating agent emulsion composition. In some embodiments, the aqueous fluid may be present in the consolidating agent emulsions in an amount in the range of about 95% to 99.9% by weight of the consolidating agent emulsion composition.

The consolidating agent in the emulsion may be either a nonaqueous tackifying agent or a resin, such as those described above. A consolidating agent may be present in a consolidating agent emulsion in an amount in the range of about 0.1% to about 80% by weight of the consolidating agent emulsion composition. In some embodiments, a consolidating agent may be present in a consolidating agent emulsion in an amount in the range of about 0.1% to about 40% by weight of the composition. In some embodiments, a consolidating agent may be present in a consolidating agent emulsion in an amount in the range of about 0.1% to about 5% by weight of the composition.

As previously stated, the consolidating agent emulsions comprise an emulsifying agent. Examples of suitable emulsifying agents may include surfactants, proteins, hydrolyzed proteins, lipids, glycolipids, and nanosized particulates, including, but not limited to, fumed silica. Combinations of these may be suitable as well.

Surfactants that may be used in suitable consolidating agent emulsions are those capable of emulsifying an organic-based component in an aqueous-based component so that the emulsion has an aqueous external phase and an organic internal phase. In some embodiments, the surfactant may comprise an amine surfactant. Such suitable amine surfactants include, but are not limited to, amine ethoxylates and amine ethoxylated quaternary salts such as tallow diamine and tallow triamine exthoxylates and quaternary salts. Examples of suitable surfactants are ethoxylated $C_{12}$-$C_{22}$ diamine, ethoxylated $C_{12}$-$C_{22}$ triamine, ethoxylated $C_{12}$-$C_{22}$ tetraamine, ethoxylated $C_{12}$-$C_{22}$ diamine methylchloride quat, ethoxylated $C_{12}$-$C_{22}$ triamine methylchloride quat, ethoxylated $C_{12}$-$C_{22}$ tetraamine methylchloride quat, ethoxylated $C_{12}$-$C_{22}$ diamine reacted with sodium chloroacetate, ethoxylated $C_{12}$-$C_{22}$ triamine reacted with sodium chloroacetate, ethoxylated $C_{12}$-$C_{22}$ tetraamine reacted with sodium chloroacetate, ethoxylated $C_{12}$-$C_{22}$ diamine acetate salt, ethoxylated $C_{12}$-$C_{22}$ diamine hydrochloric acid salt, ethoxylated $C_{12}$-$C_{22}$ diamine glycolic acid salt, ethoxylated $C_{12}$-$C_{22}$ diamine DDBSA salt, ethoxylated $C_{12}$-$C_{22}$ triamine acetate salt, ethoxylated $C_{12}$-$C_{22}$ triamine hydrochloric acid salt, ethoxylated $C_{12}$-$C_{22}$ triamine glycolic acid salt, ethoxylated $C_{12}$-$C_{22}$ triamine DDBSA salt, ethoxylated $C_{12}$-$C_{22}$ tetraamine acetate salt, ethoxylated $C_{12}$-$C_{22}$ tetraamine hydrochloric acid salt, ethoxylated $C_{12}$-$C_{22}$ tetraamine glycolic acid salt, ethoxylated $C_{12}$-$C_{22}$ tetraamine DDBSA salt, pentamethylated $C_{12}$-$C_{22}$ diamine quat, heptamethylated $C_{12}$-$C_{22}$ diamine quat, nonamethylated $C_{12}$-$C_{22}$ diamine quat, and combinations thereof.

In some embodiments, a suitable amine surfactant may have the general formula:

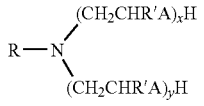

wherein R is a $C_{12}$-$C_{22}$ aliphatic hydrocarbon; R' is independently selected from hydrogen or $C_1$ to $C_3$ alkyl group; A is independently selected from NH or O, and x+y has a value greater than or equal to one but also less than or equal to three. Preferably, the R group is a non-cyclic aliphatic. In some embodiments, the R group contains at least one degree of unsaturation, i.e., at least one carbon-carbon double bond. In other embodiments, the R group may be a commercially recognized combination of aliphatic hydrocarbons such as soya, which is a combination of $C_{14}$ to $C_{20}$ hydrocarbons; or tallow, which is a combination of $C_{16}$ to $C_{20}$ aliphatic hydrocarbons; or tall oil, which is a combination of $C_{14}$ to $C_{18}$ aliphatic hydrocarbons. In other embodiments, one in which the A group is NH, the value of x+y is preferably two, with x having a preferred value of one. In other embodiments, in which the A group is O, the preferred value of x+y is two, with the value of x being preferably one. Commercially available surfactant examples include ETHOMEEN T/12, a diethoxylated tallow amine; ETHOMEEN S/12, a diethoxylated soya amine; DUOMEEN O, a N-oleyl-1,3-diaminopropane; DUOMEEN T, a N-tallow-1,3-diaminopropane; all of which are commercially available from Akzo Nobel at various locations.

In other embodiments, the surfactant may be a tertiary alkyl amine ethoxylate. TRITON RW-100 surfactant and TRITON RW-150 surfactant are examples of tertiary alkyl amine ethoxylates that are commercially available from Dow Chemical Company.

In other embodiments, the surfactant may be a combination of an amphoteric surfactant and an anionic surfactant. In some embodiments, the relative amounts of the amphoteric surfactant and the anionic surfactant in the surfactant combination may be of about 30% to about 45% by weight of the surfactant combination and of about 55% to about 70% by weight of the surfactant combination, respectively. The amphoteric surfactant may be lauryl amine oxide, a combination of lauryl amine oxide and myristyl amine oxide (i.e., a lauryl/myristyl amine oxide), cocoamine oxide, lauryl betaine, and oleyl betaine, or combinations thereof, with the lauryl/myristyl amine oxide being preferred. The cationic surfactant may be cocoalkyltriethyl ammonium chloride, and hexadecyltrimethyl ammonium chloride, or combinations thereof, with a 50/50 combination by weight of the cocoalkyltriethyl ammonium chloride and the hexadecyltrimethyl ammonium chloride being preferred.

In other embodiments, the surfactant may be a nonionic surfactant. Examples of suitable nonionic surfactants include, but are not limited to, alcohol oxylalkylates, alkyl phenol oxylalkylates, nonionic esters, such as sorbitan esters, and alkoxylates of sorbitan esters. Examples of suitable surfactants include, but are not limited to, castor oil alkoxylates, fatty acid alkoxylates, lauryl alcohol alkoxylates, nonylphenol alkoxylates, octylphenol alkoxylates, tridecyl alcohol alkoxylates, such as polyoxyethylene ("POE")-10 nonylphenol ethoxylate, POE-100 nonylphenol ethoxylate, POE-12 nonylphenol ethoxylate, POE-12 octylphenol ethoxylate, POE-12 tridecyl alcohol ethoxylate, POE-14 nonylphenol ethoxylate, POE-15 nonylphenol ethoxylate, POE-18 tridecyl alcohol ethoxylate, POE-20 nonylphenol ethoxylate, POE-20 oleyl alcohol ethoxylate, POE-20 stearic acid ethoxylate, POE-3 tridecyl alcohol ethoxylate, POE-30 nonylphenol ethoxylate, POE-30 octylphenol ethoxylate, POE-34 nonylphenol ethoxylate, POE-4 nonylphenol ethoxylate, POE-40 castor oil ethoxylate, POE-40 nonylphenol ethoxylate, POE-40 octylphenol ethoxylate, POE-50 nonylphenol ethoxylate, POE-50 tridecyl alcohol ethoxylate, POE-6 nonylphenol ethoxylate, POE-6 tridecyl alcohol ethoxylate, POE-8 nonylphenol ethoxylate, POE-9 octylphenol ethoxylate, mannide monooleate, sorbitan isostearate, sorbitan laurate, sorbitan monoisostearate, sorbitan monolaurate, sorbitan monooleate, sorbitan monopalmitate, sorbitan monostearate, sorbitan oleate, sorbitan palmitate, sorbitan sesquioleate, sorbitan stearate, sorbitan trioleate, sorbitan tristearate, POE-20 sorbitan monoisostearate ethoxylate, POE-20 sorbitan monolaurate ethoxylate, POE-20 sorbitan monooleate ethoxylate, POE-20 sorbitan monopalmitate ethoxylate, POE-20 sorbitan monostearate ethoxylate, POE-20 sorbitan trioleate ethoxylate, POE-20 sorbitan tristearate ethoxylate, POE-30 sorbitan tetraoleate ethoxylate, POE-40 sorbitan tetraoleate ethoxylate, POE-6 sorbitan hexastearate ethoxylate, POE-6 sorbitan monstearate ethoxylate, POE-6 sorbitan tetraoleate ethoxylate, and/or POE-60 sorbitan tetrastearate ethoxylate. Some suitable nonionic surfactants include alcohol oxyalkyalates such as POE-23 lauryl alcohol, and alkyl phenol ethoxylates such as POE (20) nonyl phenyl ether.

While cationic, amphoteric, and nonionic surfactants are thought to be most suitable, any suitable emulsifying surfactant may be used. Good surfactants for emulsification typically need to be either ionic, to give charge stabilization, to have a sufficient hydrocarbon chain length or cause a tighter packing of the hydrophobic groups at the oil/water interface to increase the stability of the emulsion. One of ordinary skill in the art, with the benefit of this disclosure, will be able to select a suitable surfactant depending upon the consolidating agent that is being emulsified. Additional suitable surfactants may include other cationic surfactants and even anionic surfactants. Examples include, but are not limited to, hexahydro-1 3,5-tris (2-hydroxyethyl) triazine, alkyl ether phosphate, ammonium lauryl sulfate, ammonium nonylphenol ethoxylate sulfate, branched isopropyl amine dodecylbenzene sulfonate, branched sodium dodecylbenzene sulfonate, dodecylbenzene sulfonic acid, branched dodecylbenzene sulfonic acid, fatty acid sulfonate potassium salt, phosphate esters, POE-1 ammonium lauryl ether sulfate, OE-1 sodium lauryl ether sulfate, POE-10 nonylphenol ethoxylate phosphate ester, POE-12 ammonium lauryl ether sulfate, POE-12 linear phosphate ester, POE-12 sodium lauryl ether sulfate, POE-12 tridecyl alcohol phosphate ester, POE-2 ammonium lauryl ether sulfate, POE-2 sodium lauryl ether sulfate, POE-3 ammonium lauryl ether sulfate, POE-3 disodium alkyl ether sulfosuccinate, POE-3 linear phosphate ester, POE-3 sodium lauryl ether sulfate, POE-3 sodium octylphenol ethoxylate sulfate, POE-3 sodium tridecyl ether sulfate, POE-3 tridecyl alcohol phosphate ester, POE-30 ammonium lauryl ether sulfate, POE-30 sodium lauryl ether sulfate, POE-4 ammonium lauryl ether sulfate, POE-4 ammonium nonylphenol ethoxylate sulfate, POE-4 nonyl phenol ether sulfate, POE-4 nonylphenol ethoxylate phosphate ester, POE-4 sodium lauryl ether sulfate, POE-4 sodium nonylphenol ethoxylate sulfate, POE-4 sodium tridecyl ether sulfate, POE-50 sodium lauryl ether sulfate, POE-6 disodium alkyl ether sulfosuccinate, POE-6 nonylphenol ethoxylate phosphate ester, POE-6 tridecyl alcohol phosphate ester, POE-7 linear phosphate ester, POE-8 nonylphenol ethoxylate phosphate ester, potassium dodecylbenzene sulfonate, sodium 2-ethyl hexyl sulfate, sodium alkyl ether sulfate, sodium alkyl sulfate, sodium alpha olefin sulfonate, sodium decyl sulfate, sodium dodecylbenzene sulfonate, sodium lauryl sulfate, sodium lauryl sulfoacetate, sodium nonylphenol ethoxylate sulfate, and/or sodium octyl sulfate.

Other suitable emulsifying agents are described in U.S. Pat. Nos. 6,653,436 and 6,956,086, both issued to Back, et al., the disclosures of which are herein incorporated by reference.

In some embodiments, the emulsifying agent may function in more than one capacity. For example, in some embodiments, a suitable emulsifying agent may also be a hardening agent. Examples of suitable emulsifying agents that may also function as a hardening agent include, but are not limited to, those described in U.S. Pat. No. 5,874,490, the disclosure of which is herein incorporated by reference.

In some embodiments, the emulsifying agent may be present in the consolidating agent emulsion in an amount in the range of about 0.001% to about 10% by weight of the consolidating agent emulsion composition. In some embodiments, the emulsifying agent may be present in the consolidating agent emulsion in an amount in the range of about 0.05% to about 5% by weight of the consolidating agent emulsion composition.

Optionally, a consolidating agent emulsion may comprise additional additives such as emulsion stabilizers, emulsion destabilizers, antifreeze agents, biocides, algaecides, pH control additives, oxygen scavengers, clay stabilizers, and the like, or any other additive that does not adversely affect the consolidating agent emulsion compositions. For instance, an emulsion stabilizer may be beneficial when stability of the emulsion is desired for a lengthened period of time or at specified temperatures. The emulsion stabilizer may be any acid. In some embodiments, the emulsion stabilizer may be an organic acid, such as acetic acid. In some embodiments, the emulsion stabilizer may be a plurality of nanoparticulates. If an emulsion stabilizer is utilized, it is preferably present in an amount necessary to stabilize the consolidating agent emulsion composition. An emulsion destabilizer may be beneficial when stability of the emulsion is not desired. The emulsion destabilizer may be, inter alia, an alcohol, a pH additive, a surfactant, or an oil. If an emulsion destabilizer is utilized, it is preferably present in an amount necessary to break the emulsion. Additionally, antifreeze agents may be beneficial to improve the freezing point of the emulsion. In some embodiments, optional additives may be included in the consolidating agent emulsion in an amount in the range of about 0.001% to about 10% by weight of the consolidating agent emulsion composition. One of ordinary skill in the art, with the benefit of this disclosure, will recognize that the compatibility of any given additive should be tested to ensure that it does not adversely affect the performance of the consolidating agent emulsion.

In some embodiments, a consolidating agent emulsion may further comprise a foaming agent. As used herein, the term "foamed" also refers to co-mingled fluids. In certain embodiments, it may desirable that the consolidating agent emulsion is foamed to, inter alia, provide enhanced placement of a consolidating agent emulsion composition and/or to reduce the amount of aqueous fluid that may be required, e.g., in water-sensitive subterranean formations. Various gases can be utilized for foaming the consolidating agent emulsions of this invention, including, but not limited to, nitrogen, carbon dioxide, air, and methane, and combinations thereof. One of ordinary skill in the art, with the benefit of this disclosure, will be able to select an appropriate gas that may be utilized for foaming the consolidating agent emulsions. In some embodiments, the gas may be present in a consolidating agent emulsion in an amount in the range of about 5% to about 98% by volume of the consolidating agent emulsion. In some embodiments, the gas may be present in a consolidating agent emulsion in an amount in the range of about 20% to about 80% by volume of the consolidating agent emulsion. In some embodiments, the gas may be present in a consolidating agent emulsion in an amount in the range of about 30% to about 70% by volume of the consolidating agent emulsion. The amount of gas to incorporate into the consolidating agent emulsion may be affected by factors, including the viscosity of the consolidating agent emulsion and wellhead pressures involved in a particular application.

In those embodiments where it is desirable to foam the consolidating agent emulsion, surfactants such as HY-CLEAN(HC-2)™ surface-active suspending agent, PEN-5™, or AQF-2™ additive, all of which are commercially available from Halliburton Energy Services, Inc., of Duncan, Okla., may be used. Additional examples of foaming agents that may be utilized to foam and stabilize the consolidating agent emulsions may include, but are not limited to, betaines, amine oxides, methyl ester sulfonates, alkylamidobetaines such as cocoamidopropyl betaine, alpha-olefin sulfonate, trimethyltallowammonium chloride, $C_8$ to $C_{22}$ alkylethoxylate sulfate and trimethylcocoammonium chloride. Other suitable foaming agents and foam-stabilizing agents may be included as well, which will be known to those skilled in the art with the benefit of this disclosure.

In some embodiments, it may be desirable to utilize a pre-flush fluid prior to the placement of the consolidating agent in a subterranean formation, inter alia, to remove excess fluids from the pore spaces in the subterranean formation, to clean the subterranean formation, etc. Examples of suitable pre-flush fluids include, but are not limited to, aqueous fluids, solvents, and surfactants capable of altering the wetability of the formation surface. Examples of suitable pre-flush solvents may include mutual solvents such as MUSOL® and N-VER-SPERSE A™, both commercially available from Halliburton Energy Services, Inc., of Duncan, Okla. An example of a suitable pre-flush surfactant may also include an ethoxylated nonylphenol phosphate ester such as ES-5™, which is commercially available from Halliburton Energy Services, Inc., of Duncan, Okla. Additionally, in those embodiments where the consolidating agent comprises a resin composition, it may be desirable to include a hardening agent in a pre-flush fluid.

Additionally, in some embodiments, it may be desirable to utilize a post-flush fluid subsequent to the placement of the consolidating agent in a subterranean. formation, inter alia, to displace excess consolidating agent from the near well bore region. Examples of suitable post-flush fluids include, but are not limited to, aqueous fluids, surfactants, solvents, or gases (e.g., nitrogen), or any combination thereof. Additionally, in some embodiments, in may be desirable to include a hardening agent in the post-flush fluid. For example, certain types of resin compositions, including, but not limited to, furan-based resins, urethane resins, and epoxy-based resins, may be catalyzed with a hardening agent placed in a post-flush fluid.

As will be recognized by one of ordinary skill in the art, a consolidating agent may be placed into at least a portion of the subterranean formation by any suitable method, including bullheading the consolidating agent into the subterranean formation, using a strategic placement tool, and the like.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by any amount (e.g., 1 percent, 2 percent, 5 percent, or, sometimes, 10 to 20 percent). Whenever a numerical range, R, with a lower limit, RL, and an upper limit, RU, is disclosed, any number falling within the range is specifically disclosed. In particular, the following numbers within the range are specifically disclosed: R=RL+k*(RU−RL), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A method comprising:

placing a sand control screen in the wellbore penetrating the subterranean formation, wherein the sand control screen comprises:

a base pipe having at least one opening in a sidewall portion thereof;

a swellable material layer disposed exteriorly of the base pipe and having at least one opening corresponding to the at least one opening of the base pipe;

a telescoping perforation operably associated with the at least one opening of the base pipe and at least partially disposed within the at least one opening of the swellable material layer; and a filter medium disposed within the telescoping perforation; and introducing a consolidating agent into at least a portion of a subterranean formation.

2. The method of claim 1 wherein introducing the consolidating agent into at least a portion of the subterranean formation occurs after the placement of the sand control screen.

3. The method of claim 1 wherein in the swellable material layer radially expands in response to contact with an activating fluid.

4. The method of claim 3 wherein the activating fluid is a hydrocarbon.

5. The method of claim 3 wherein introducing the consolidating agent into at least a portion of the subterranean formation occurs after the swellable material layer radially expands.

6. The method of claim 1 wherein the swellable material comprises at least one swellable material selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

7. The method of claim 1 wherein the consolidating agent comprises at least one consolidating agent selected from the group consisting of: a non-aqueous tackifying agent, an aqueous tackifying agent, a resin, a silyl-modified polyamide compound, a consolidating agent emulsion, and any combination thereof.

8. A method comprising:

placing a sand control screen in the wellbore penetrating the subterranean formation, wherein the sand control screen comprises:

a base pipe having at least one opening in a sidewall portion thereof;

a swellable material layer disposed exteriorly of the base pipe and having at least one opening corresponding to the at least one opening of the base pipe;

a telescoping perforation operably associated with the at least one opening of the base pipe and at least partially disposed within the at least one opening of the swellable material layer; and a filter medium disposed within the telescoping perforation;

introducing a consolidating agent into at least a portion of a subterranean formation; and contacting the swellable material layer with an activating fluid, wherein, in response to contact with an activating fluid, radial expansion of the swellable material layer causes the telescoping perforation to radially outwardly extend.

9. The method of claim 8 wherein introducing the consolidating agent into at least a portion of the subterranean formation occurs after the placement of the sand control screen.

10. The method of claim 8 wherein introducing the consolidating agent into at least a portion of the subterranean formation occurs after the telescoping perforation radially outwardly extends.

11. The method of claim 8 wherein the activating fluid is a hydrocarbon.

12. The method of claim 8 wherein the swellable material comprises at least one swellable material selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

13. The method of claim 8 wherein the consolidating agent comprises at least one consolidating agent selected from the group consisting of: a non-aqueous tackifying agent, an aqueous tackifying agent, a resin, a silyl-modified polyamide compound, a consolidating agent emulsion, and any combination thereof.

14. A method comprising:

placing a sand control screen in the wellbore penetrating the subterranean formation, wherein the sand control screen comprises:

a base pipe having a plurality of openings in a sidewall portion thereof and defining an internal flow path;

a swellable material layer disposed exteriorly of the base pipe and having a plurality of openings that correspond to the openings of the base pipe;

a plurality of telescoping perforations, each of the telescoping perforations operably associated with one of the openings of the base pipe and at least partially disposed within the corresponding opening of the swellable material layer, the telescoping perforations providing fluid flow paths between a fluid source disposed exteriorly of the base pipe and the interior flow path; and a filter medium disposed within each of the telescoping perforations; and introducing a consolidating agent into at least a portion of a subterranean formation.

15. The method of claim 14 wherein introducing the consolidating agent into at least a portion of the subterranean formation occurs after the placement of the sand control screen.

16. The method of claim 14 wherein in the swellable material layer radially expands in response to contact with an activating fluid.

17. The method of claim 16 wherein the activating fluid is a hydrocarbon.

18. The method of claim 16 wherein introducing the consolidating agent into at least a portion of the subterranean formation occurs after the swellable material layer radially expands.

19. The method of claim 14 wherein the swellable material comprises at least one swellable material selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

20. The method of claim 14 wherein the consolidating agent comprises at least one consolidating agent selected from the group consisting of: a non-aqueous tackifying agent, an aqueous tackifying agent, a resin, a silyl-modified polyamide compound, a consolidating agent emulsion, and any combination thereof.

* * * * *